US009348290B2

(12) United States Patent
Oomoto et al.

(10) Patent No.: US 9,348,290 B2
(45) Date of Patent: May 24, 2016

(54) SHEET CONVEYING DEVICE AND IMAGE FORMING APPARATUS

(71) Applicant: KONICA MINOLTA INC., Chiyoda-ku, Tokyo (JP)

(72) Inventors: Noboru Oomoto, Toyokawa (JP); Atsuhiko Shimoyama, Tahara (JP); Shinichi Yabuki, Toyokawa (JP); Ryo Oshima, Anjo (JP)

(73) Assignee: KONICA MINOLTA INC., Tokyo (JP)

( * ) Notice: Subject to any disclaimer, the term of this patent is extended or adjusted under 35 U.S.C. 154(b) by 0 days.

(21) Appl. No.: 14/801,201

(22) Filed: Jul. 16, 2015

(65) Prior Publication Data

US 2016/0026140 A1 Jan. 28, 2016

(30) Foreign Application Priority Data

Jul. 28, 2014 (JP) ..... 2014-153054

(51) Int. Cl.
*G03G 15/20* (2006.01)
*G03G 15/00* (2006.01)

(52) U.S. Cl.
CPC ..... *G03G 15/6529* (2013.01)

(58) Field of Classification Search
CPC ..... G03G 15/6529; G03G 15/2085; G03G 15/2028
USPC ..... 399/323
See application file for complete search history.

(56) References Cited

U.S. PATENT DOCUMENTS

2009/0194938 A1 8/2009 Mizutani
2010/0086318 A1* 4/2010 Nishino ..... G03G 15/2028 399/21
2011/0033214 A1* 2/2011 Funabiki ..... G03G 15/2028 399/323

FOREIGN PATENT DOCUMENTS

JP 08036329 A * 2/1996
JP 2002196610 A 7/2002
JP 2007108618 A 4/2007
JP 2007-212807 * 8/2007
JP 2007233203 A 9/2007
JP 2009186697 A 8/2009

* cited by examiner

*Primary Examiner* — Billy Lactaoen
(74) *Attorney, Agent, or Firm* — Holtz, Holtz & Volek PC

(57) ABSTRACT

A sheet conveying device that passes a sheet to a nip portion formed between first and second rotating bodies, and conveys the sheet, the sheet conveying device includes a separation state determining unit configured to determine a separation state between the sheet having passed the nip portion and a surface of the first rotating body, a sheet separating unit configured to allow force to act on the sheet, and a control unit configured to control the force acting on the sheet by the sheet separating unit according to a result of the separation state determining unit, wherein the separation state determining unit includes an illumination unit, an imaging unit, and an acquisition unit, and the separation state between the sheet and the first rotating body is determined based on the acquired positional information of a tip of the sheet.

19 Claims, 23 Drawing Sheets

| P1 | P2 | P3 | P4 | P5 | P6 | ···· | P13 | P14 | P15 | P16 | P17 | P18 |
|---|---|---|---|---|---|---|---|---|---|---|---|---|
| 1 | 1 | 1 | 2 | 2 | 2 | ···· | 2 | 1 | 1 | 1 | 1 | 1 |

SHEET CONVEYING DEVICE AND IMAGE FORMING APPARATUS

The entire disclosure of Japanese Patent Application No. 2014-153054 filed on Jul. 28, 2014 including description, claims, drawings, and abstract are incorporated herein by reference in its entirety.

BACKGROUND OF THE INVENTION

1. Field of the Invention

The present invention relates to a sheet conveying device and an image forming apparatus including the sheet conveying device.

2. Description of the Related Art

An image forming apparatus in an electrophotographic system exposes and scans a surface of a photoreceptor based on image data of a document to form an electrostatic latent image, supplies a toner to the electrostatic latent image to generate a toner image, transfers the toner image on a recording sheet, and then thermally fixes the toner image in a fixing device.

Typically, the fixing device has a configuration of passing a recording sheet to a nip portion formed between a heated fixing roller (fixing rotating body) and a pressure roller (pressure rotating body) pressed against the fixing roller, and conveying the sheet forward while thermally fixing the sheet. The recording sheet adheres to a surface of the fixing roller by adhesive force of a toner heated in the nip portion and becomes in a fused state. Accordingly, the recording sheet is not separated from the fixing roller, and a jam (separation jam) occurs. In a worst case, the recording sheet fully winds around the fixing roller, and maintenance becomes an enormous burden.

Therefore, a configuration of forming a mold release layer mainly made of a fluororesin on the surface of the fixing roller to make the recording sheet be easily separated is employed, and it is devised to cause the recording sheet to be able to be separated by itself due to a curvature of a peripheral surface of the fixing roller, and firmness of the recording sheet itself (curvature separation).

Nonetheless, when a sheet without having firmness such as a thin paper or a thin-paper-coated sheet is used as the recording sheet, or when there is a large amount of adhesion of a toner to the recording sheet, such as a solid image, a possibility of occurrence of the separation jam may become high.

To solve such a problem, a method (separating claw system) of bringing a separating claw to come in contact with the peripheral surface of the fixing roller to forcibly separate the recording sheet from the fixing roller can be considered, for example. However, if the separating claw is in contact with the peripheral surface of the fixing roller on a steady basis, a portion of the peripheral surface of the fixing roller, the portion being contact with the separation claw, is worn away, and nonuniformity may occur in a fixing property. As a forcible sheet separating mechanism, there is a method of separating the recording sheet without generating scratches in the peripheral surface of the fixing roller, by strongly blowing air from a tip of a nozzle to a gap slightly caused between a tip of the recording sheet and the periphery surface of the fixing roller according to the curvature separation, and forcibly separating the recording sheet in a non-contact manner, in place of the separating claw system (hereinafter, may be referred to as "air type separation system"). However, heat is taken from the fixing roller by the air flow on a steady basis.

Therefore, there is a problem of an increase in power consumption for maintaining the fixing roller to have a fixing temperature.

Therefore, for example, JP 2007-108618 A operates the sheet separating mechanism only when a separation state between the recording sheet and the fixing roller is defective while adopting the separating claw system.

That is, as illustrated in FIG. 24A, a configuration of forcibly separating a recording sheet S, by measuring a distance to a tip portion of the recording sheet S, which has passed a nip portion N formed between a fixing roller 543 and a pressure roller 544, with a laser displacement sensor 545, to calculate a winding index value, determining that a separation property is deteriorated due to expiration of life of the fixing roller 543 when the winding index value becomes larger than a predetermined value, and operating the sheet separating mechanism, for sheet passing on and after the recording sheet S while issuing a warning to a user.

In this sheet separating mechanism 560, a holding member 562, which holds the separating claw 563, is pivotally fixed to a main body frame (not illustrated) of the fixing device with a support shaft 562*a* at a base end part of the sheet separating mechanism 560 in a swingable manner. The holding member 562 is energized to a direction of being in contact with a cam plate 561 by a spring member (not illustrated), and when the separation state between the recording sheet and the fixing roller is determined to be deteriorated, the cam 561 is rotated by a drive source such as a motor, so that the holding member 562 swings in the arrow direction, and a tip of the separating claw 563 comes in contact with the peripheral surface of the fixing roller 543.

If the separation state of the recording sheet is determined using such a technology, and the sheet separating mechanism is operated only when the separation state is not favorable, the degree of the flaw occurring in the peripheral surface of the fixing roller can be substantially decreased and durability can be improved, in the case of the separating claw system. There is a high possibility of avoiding the inconvenience that the heat is taken from the fixing roller on a steady basis and the power consumption is increased, in the case where the sheet separating mechanism is the air type separation system.

By the way, the laser displacement sensor used for determination of the sheet separation state in JP 2007-108618 A has a configuration of detecting displacement of a spot position of reflection light of laser light from the recording sheet surface to measure a distance. Therefore, to accurately detect the distance, it is desirable to arrange the laser displacement sensor in a position where an amount of the reflection light from a body to be detected (the recording sheet) is large. Therefore, it is necessary to irradiate the recording sheet surface with the laser light from an angle as nearly perpendicular as possible to the recording sheet surface (condition a).

Further, to determine the separation state between the recording sheet and the fixing roller 543, it is desirable to measure a state of the tip of the recording sheet immediately after the tip has passed the nip portion (condition b).

However, if an incident angle of the laser to the recording sheet is brought to achieve a right angle, and the measurement is performed with the laser displacement sensor 545 of the recording sheet near the nip portion, in order to satisfy both of the conditions a and b, the laser displacement sensor 545 interferes with the pressure roller 544, like a laser displacement sensor 545' illustrated by the two-dotted chain line of FIG. 24B. In a real sense, installation is difficult.

Therefore, as illustrated in FIG. 24A, in JP 2007-108618 A, the laser displacement sensor 545 is forced to be arranged slightly diagonally forward in an advancing direction of the recording sheet. In this case, the position of the tip of the recording sheet immediately after the tip of the recording sheet has passed the nip portion cannot be accurately measured. As a result, determination accuracy of the separation state becomes worse and a determination time becomes late.

Especially, in recent years, a conveying speed of the recording sheet is increased in order to improve productivity. If the determination of the defectiveness of the separation of the recording sheet is late, the operation of the sheet separating mechanism cannot be in time, and there is a high possibility that the separation jam and winding of the recording sheet to the fixing roller cannot be avoided in advance.

The problems of the separation jam and the winding are caused not only in the nip portion between the fixing roller and the pressure roller, but also in a case where some sort of adhesive force occurs between the sheet surface as an object to be conveyed and the surface of the rotating body, in a configuration in which the sheet is conveyed by being passed to the nip portion of a pair of rotating bodies. Therefore, a technology to accurately detect the separation state between the sheet and the surface of the rotating body is desired.

SUMMARY OF THE INVENTION

The present invention has been made in view of the foregoing, and an object thereof is to provide a sheet conveying device and an image forming apparatus including the sheet conveying device, which can promptly and adequately determine the separation state between the sheet and the rotating body, and can prevent occurrence of a trouble such as the separation jam, in advance, while avoiding harmful influence of operating the sheet separating mechanism on a steady basis, when the sheet is transferred while being held by the nip portion formed of a pair of rotating bodies.

To achieve the abovementioned object, according to an aspect, a sheet conveying device that passes a sheet to a nip portion formed between first and second rotating bodies and conveys the sheet, the sheet conveying device reflecting one aspect of the present invention comprises: a separation state determining unit configured to determine a separation state between the sheet having passed the nip portion and a surface of the first rotating body; a sheet separating unit configured to allow force to act on the sheet, the force being in a direction of being separated from the surface of the first rotating body; and a control unit configured to control the force acting on the sheet by the sheet separating unit according to a result of the separation state determining unit, wherein the separation state determining unit includes an illumination unit configured to illuminate an outlet side of the nip portion in a sheet passing direction, an imaging unit configured to image a tip portion of the sheet having passed the nip portion, and an acquisition unit configured to acquire positional information of a tip of the sheet based on image data obtained by the imaging unit, and the separation state between the sheet and the first rotating body is determined based on the acquired positional information of a tip of the sheet.

The sheet conveying device desirably comprises a detecting unit configured to detect passing of the tip of the sheet at an upper stream side than the nip portion in a sheet conveying direction, and the imaging unit desirably images the tip portion of the sheet using timing when the tip of the sheet is detected by the detecting unit is a reference time, and setting timing after a lapse of a predetermined time from the reference time as imaging timing.

Further, the sheet conveying device desirably comprises a detecting unit configured to detect passing of the tip of the sheet at an upper stream side than the nip portion in a sheet conveying direction, the imaging unit desirably sequentially images the tip portion of the sheet having passed the nip portion, and the acquisition unit acquires the positional information of a tip of the sheet, based on image data imaged at timing after a lapse of a predetermined time from a reference time, using timing when the tip of the sheet is detected by the detecting unit as the reference time, of image data obtained through the sequential imaging.

The imaging unit is desirably arranged in a position at a downstream side of the nip portion in a sheet conveying direction, and is desirably a position where the imaging unit images a back surface side of the tip portion of the sheet when the tip portion of the sheet having passed the nip portion approaches a peripheral surface of the first rotating body, and the illumination unit is desirably arranged in a position where a shadow of the tip portion of the sheet is generated on the peripheral surface of the first rotating body, and the appearing shadow is imaged by the imaging unit.

Further, the imaging unit is desirably arranged in a position at a downstream side of the nip portion in a sheet conveying direction, and is desirably a position where the imaging unit is able to image an end surface of the tip of the sheet when the tip portion of the sheet having passed the nip portion approaches a peripheral surface of the first rotating body, and the illumination unit is desirably arranged in a position where the illumination unit illuminates the end surface of the tip of the sheet.

The imaging unit desirably includes one or a plurality of line sensors arranged such that an imaging range becomes a range extending in a direction perpendicular to a direction into which the nip portion is extended.

Further, the imaging unit is desirably an area sensor.

The illumination unit is desirably a slit light source that performs irradiation through a slit, and the separation state determining unit desirably determines the separation state, based on a captured image of projection light to a peripheral surface of the first rotating body and the tip portion of the sheet, of the slit light source.

Further, the sheet conveying device desirably comprises a sheet width acquisition unit configured to acquire information related to a sheet width in a direction perpendicular to the sheet passing direction of a passed sheet, and the imaging unit desirably switches an imaging range in the direction perpendicular to the sheet passing direction according to a size of the sheet width, and images the tip portion of the sheet.

Further, the sheet conveying device desirably comprises a deteriorating tendency determining unit configured to determine, when a plurality of sheets is sequentially passed, whether the separation state is in deteriorating tendency according to a history of the determination of the separating state in the passing of a most recent one sheet or a most recent plurality of sheets, and the imaging unit desirably sets only a part of a range in the sheet width direction as an imaging range until the separation state is determined to be in the deteriorating tendency by the deteriorating tendency determination unit, and switches the part of a range to a range wider than the part of a range in the sheet width direction after the separation state is determined to be in the deteriorating tendency, and images the tip portion of the sheet.

Further, when a plurality of sheets is sequentially passed, the imaging unit desirably sets an imaging range in the direction perpendicular to a direction into which the nip portion is extended, as a first range, at an initial stage, and when a position of the tip of the sheet obtained in the acquisition unit is predicted to fall within a predetermined range, the imaging unit desirably switches the imaging range to a second range narrower than the first range in the direction perpendicular to a direction into which the nip portion is extended, and images the tip portion of the sheet.

The imaging unit is desirably a two-dimensional CCD, and when a range smaller than an entire imagable range by the two-dimensional CCD is an imaging range for determination of the separation state of the sheet, a period of a transfer pulse of an electric charge of a pixel in a range other than the imaging range for determination, of the entire imagable range, is desirably made faster than a period of a transfer pulse of an electric charge of a pixel in the imaging range for determination.

Further, the separation state determining unit desirably acquires information indicating distribution of the separation state of the sheet along a direction into which the nip portion is extended, the sheet separating unit is desirably able to independently change the force acting on the sheet in the direction of being separated from the surface of the first rotating body, in a plurality of places in a sheet width direction, and the control unit desirably controls the force acting on the sheet in each of the places by the sheet separating unit based on the information indicating distribution of the separation state.

Further, the sheet conveying device desirably comprises a sheet conveying guide configured to guide the sheet after passing the nip portion, and the sheet conveying guide desirably includes a rib-like guided portion in which a plurality of ribs is arranged in a radial manner not to disturb a capturing optical path by the area sensor, of a portion that is an object to be determined of the separation state of the sheet in the nip portion.

Further, the sheet conveying device desirably comprises: a sheet conveying guide configured to guide the sheet after passing the nip portion; and an optical system configured to convert a capturing optical path into a parallel capturing optical path in a middle of the capturing optical path from the area sensor to the nip portion, and the sheet conveying guide desirably includes a rib-like guided portion in which a plurality of ribs is arranged in a radial manner not to disturb the parallel capturing optical path in which the portion that is an object to be determined of the separation state of the sheet in the nip portion is captured.

Further, an image forming apparatus desirably comprises anyone of the sheet conveying devices described above, as a conveying system of a recording sheet.

The conveying system desirably includes a fixing device, and a fixing rotating body and a pressure rotating body in the fixing device respectively desirably correspond to first and second rotating bodies in the sheet conveying device.

Further, the conveying system desirably includes a transfer device, and an image carrying rotating body that carries a toner image and a transfer rotating body that transfers the toner image on the recording sheet in the transfer device respectively desirably correspond to first and second rotating bodies in the sheet conveying device.

The image carrying rotating body is desirably a photoreceptor rotating body, and includes an eraser lamp that removes an electric charge of the photoreceptor rotating body after transfer of the toner image to the recording sheet, and the eraser lamp also desirably serves as the illumination unit for imaging in the sheet conveying device.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Hereinafter, an example in which a sheet conveying device according to an embodiment of the present invention is applied to a fixing section of a tandem type color copying machine (hereinafter, simply referred to as "copying machine") will be described.

(1) Overall Configuration of Copying Machine

Figure 1:
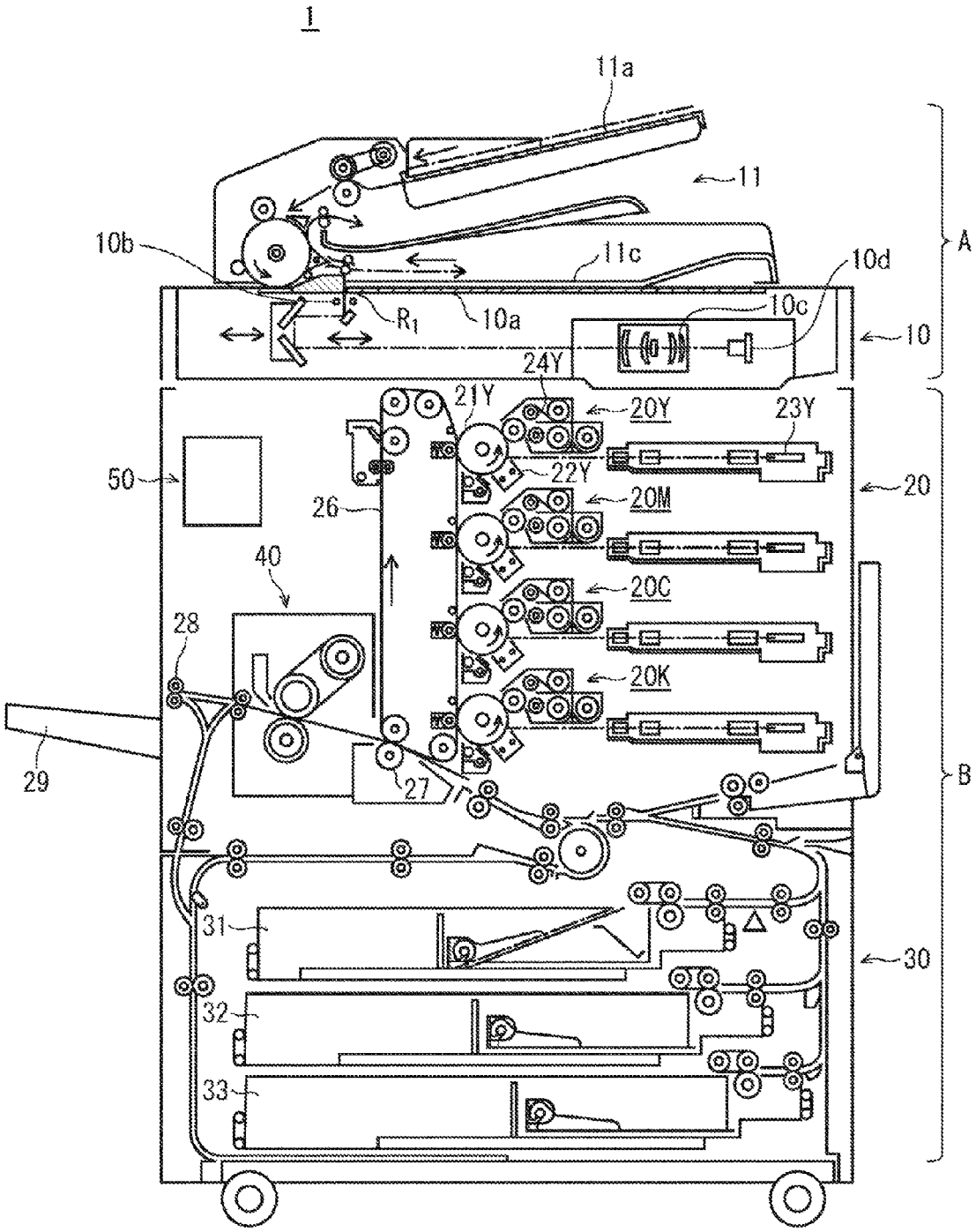
FIG. 1 is a schematic diagram for describing a configuration of a tandem type color copying machine that is an example of an image forming apparatus according to an embodiment of the present invention.

FIG. 1 is a schematic diagram for describing a configuration of a copying machine 1 according to the present embodiment.

As illustrated in FIG. 1, the copying machine 1 is roughly made of an image reader section (document reading device) A and a printer section (image forming apparatus) B.

<Image Reader Section>

The image reader section A includes a scanner section 10 that optically reads a document image and converts the document image into an image signal, and a document conveying section (ADF unit) 11 provided above the scanner section 10.

The document conveying section 11 sends out documents one by one from a bundle of documents set in a sheet feeding tray 11*a*, conveys the sheet to a reading position R1 on a platen glass 10*a*, reads a document image with the scanner section 10 at the reading position R1, and then discharges the document onto a document discharging tray 11*c*.

In the scanner section 10, light is emitted from a linear light source 10*b* made of an LED array, and reflection light from the document that passes the reading position R1 is condensed onto a line sensor 10*d* through a condensing lens group 10*c*.

The line sensor 10*d* is made by a plurality of charge coupled devices (CCDs) linearly arranged in a direction parallel to a main scanning direction, converts the reflection light incident from the document into an electrical signal, and outputs the electrical signal to a control section 50 of the printer section B.

<Printer Section>

The printer section B is made of an image forming section 20, a sheet feeding section 30, a fixing section 40, the control section 50, and the like, and forms an image on a recording sheet based on a document image read in the image reader section A, or image data transmitted from another terminal through a network.

The image forming section 20 includes an intermediate transfer belt 26 driven by a drive source (not illustrated) and going around in the arrow direction, and process units 20Y, 20M, 20C, and 20K arranged along a traveling surface in a vertical direction of the intermediate transfer belt 26.

The process units 20Y, 20M, 20C, and 20K respectively form toner images of respective colors of yellow (Y), magenta (M), cyan (C), and black (K).

These process units 20Y to 20K have similar configurations except the colors of toners to be used. Therefore, only the configuration of the process unit 20Y will be described as a representative of the configurations.

The process unit 20Y is made of a charging device 22Y, an exposing device 23Y, a developing device 24Y, and the like arranged in surroundings of the photoreceptor drum 21Y around the photoreceptor drum 21Y. An outer peripheral surface of the photoreceptor drum 21Y is uniformly charged by the charging device 22Y.

The exposing device 23Y drives and modulates a laser light source based on image data acquired in the image reader section A, and exposes and scans a surface of the charged photoreceptor drum 21Y. Accordingly, an electrostatic latent image is formed on the outer peripheral surface of the photoreceptor drum 21Y.

The electrostatic latent image is developed by the developing device 24Y with the yellow toner, and is transferred on the intermediate transfer belt 26.

Toner images of M, C, and K colors formed on the photoreceptor drums in the other process units 20M, 20C, and 20K are transferred and superimposed to the same position on the intermediate transfer belt 26, so that a color image is formed.

The toner images transferred on the intermediate transfer belt 26 are conveyed to a secondary transfer position facing a secondary transfer roller 27 by a going-round operation of the intermediate transfer belt 26.

Meanwhile, the sheet feeding section 30 includes sheet feeding cassettes 31 to 33, sends out the recording sheet from a specified sheet feeding cassette, times and conveys the recording sheet to the secondary transfer position, and secondarily transfers the toner images on the intermediate transfer belt 26 onto the recording sheet.

The recording sheet on which the toner images are transferred is thermally fixed in the fixing section 40, and is then discharged to a discharging tray 29 through a discharging roller 28.

(2) Configuration of Fixing Section 40

Figure 2:
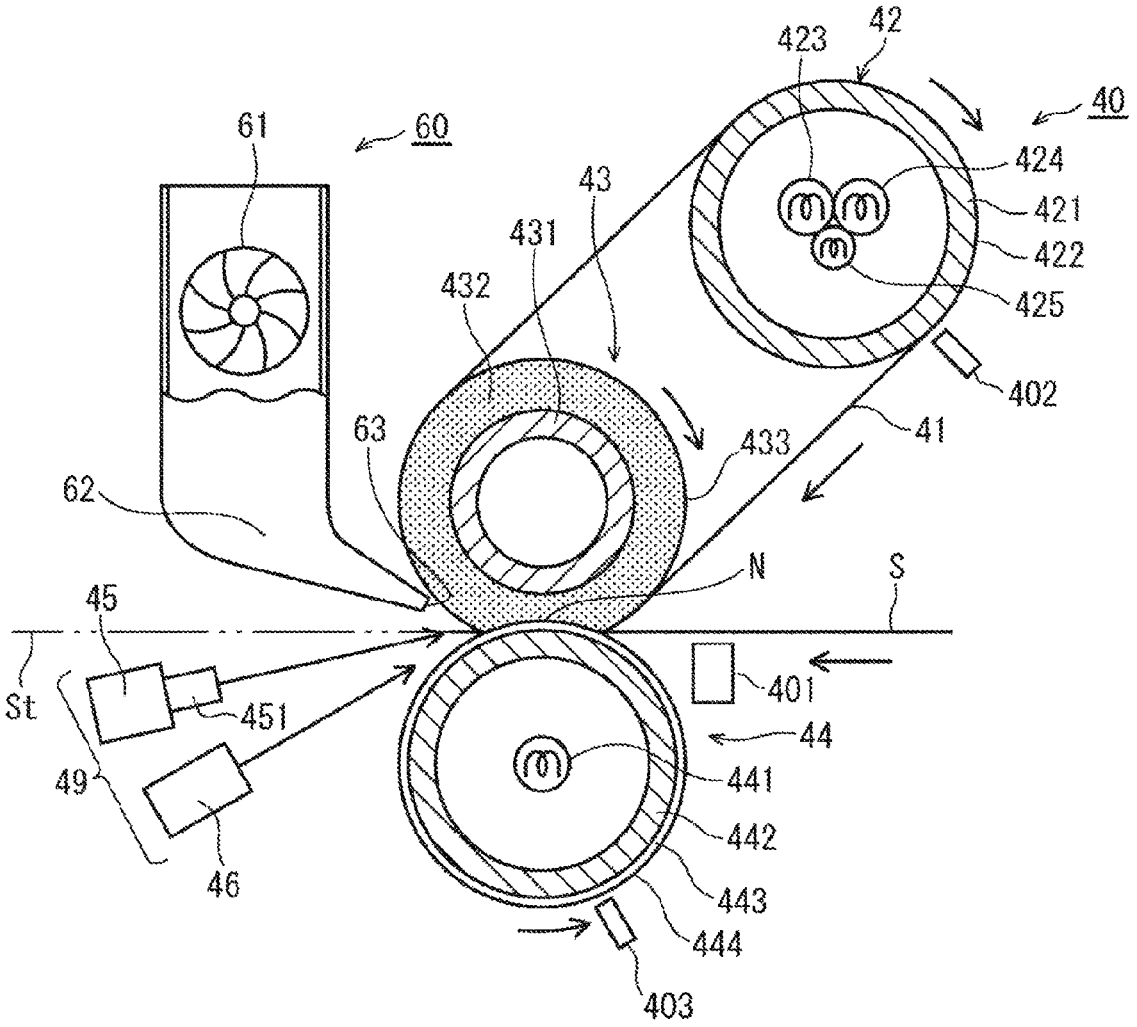
FIG. 2 is a schematic cross-sectional view for describing configurations of a fixing section and an air type separating device provided in the copying machine.

FIG. 2 is a cross-sectional configuration diagram for describing a configuration and an operation of the fixing section 40 of the first embodiment.

A fixing belt 41 as a fixing section material is formed in an endless manner, and in an embodiment, polyimide (PI) having a thickness of 70 μm is used as a base, and an outer peripheral surface of the base is coated with heat-resistant silicon rubber having a thickness of 220 μm as an elastic layer.

Further, the base is coated with a tube of perfluoroalkoxy (PFA) that is a heat-resistant resin having a thickness of 30 μm, so that a mold release layer is formed.

A heating roller 42 includes a main heating unit and an auxiliary heating unit as heating units that heat the fixing belt 41, and is formed such that an outer peripheral surface of a core bar 421 made of aluminum or the like is coated with a PTFE resin layer 422.

To support different paper widths, a central heater 423 made of a halogen heater as a main heating unit is set to have power consumption of 1080 W and an end heater 424 is set to have power consumption of 705 W. The heaters are arranged such that different heat generation distribution can be obtained in an axial direction corresponding to different paper widths of the recording sheet.

Further, an auxiliary heater 425 as the auxiliary heating unit is made of a halogen heater in which a light emission portion is formed such that an amount of heat generation in both end portions becomes larger than that in a central portion, and is set to have power consumption of 500 W.

A fixing roller 43 is formed such that a core bar 431 formed of metal such as stainless steel is coated with an elastic layer 432 made of heat-resistant silicon rubber.

A pressure roller 44 (pressure member) is formed such that an outer peripheral surface of a cylindrical core bar 442 made of aluminum or the like is coated with heat-resistant silicon rubber as an elastic layer 443.

Further, the pressure roller 44 is coated with a resin layer 444 coated with PFA having a thickness of 30 μm as a mold release layer.

A pressure roller heater 441 made of a halogen heater is arranged inside the pressure roller 44.

Further, the pressure roller 44 pressurizes the fixing roller 43 through the fixing belt 41 with an energizing unit (not illustrated), so that a nip portion N is formed. A plurality of temperature sensors 402 is arranged in a width direction of the fixing belt 41, facing a peripheral surface of the fixing belt 41 at a downstream side of a rotating direction of the heating roller 42. The temperature sensors 402 are respectively arranged at positions corresponding to heat generation portions of the central heater 423 and the end heater 424.

Further, a plurality of temperature sensors 403 is arranged facing a peripheral surface of the pressure roller 44. The temperature sensors 403 are respectively arranged at positions corresponding to central and end heat generation portions.

In the above configuration, the pressure roller 44 is driven and rotated in a counter clockwise direction with a drive unit (not illustrated), the fixing belt 41 and the heating roller 42 are rotated in a clockwise direction, and the fixing roller 43 is rotated following the fixing belt 41 in a clockwise direction, so that the recording sheet S is thermally fixed and conveyed toward the downstream side. Note that a configuration of driving and rotating the fixing roller 43 may be employed.

The control section 50 controls power supply to the halogen heaters 423 to 425, and 441 such that the fixing belt 41 and the pressure roller 44 can be maintained to have appropriate temperature at the time of fixation based on detection results of the temperature sensors 402 and 403.

<Air Type Separating Device>

In the fixing section 40, the recording sheet S may adhere to the peripheral surface of the fixing belt 41, and the separation state may be deteriorated and the separation jam may occur, depending on a toner amount on the recording sheet S when the thermally fixed recording sheet S passes the nip portion N. Therefore, it is necessary to reliably separate the recording sheet S from the fixing belt 41.

In the present embodiment, an air type separating device 60 is used as a sheet separating unit. The air type separating device 60 blows the air to a tip portion of the recording sheet S immediately after passing the nip portion N, and separates the recording sheet S from the fixing belt 41.

As illustrated in FIG. 2, the air type separating device 60 has a configuration in which a fan device 61 is arranged inside a duct main body 62, the fan device 61 is driven, and the air is discharged through a nozzle portion 63 at a tip of the duct main body. Note that, in FIG. 2, a part of the duct main body 62 is cut off, so that the inner fan device 61 can be seen.

In the present embodiment, it is desirable to set the length of the nozzle portion 63 in the width direction of the fixing belt 41 (a direction perpendicular to the paper surface of the FIG. 2) to be the same as a maximum width of the recording sheet used in the copying machine 1. However, the length may be shorter than the width of the recording sheet as long as there is an effect of sheet separation.

Typically, a margin of about several mm (a margin area where no image is formed) is provided in a peripheral edge portion of the recording sheet. Therefore, the margin portion of the tip of the recording sheet S that has passed the nip portion N is separated from the surface of the fixing belt 41 due to firmness of the recording sheet itself, and the air is blown to a gap between the recording sheet and the surface of the fixing belt 41, so that the recording sheet S can be separated from the fixing belt 41.

Switching of ON/OFF of the fan device 61 and an air blow amount at the time of driving are controlled by the control section 50 according to the degree of separation between the tip of the recording sheet and the fixing belt 41. Details will be described below.

Note that the type of the fan device 61 is not especially limited, and an axial fan, a sirocco fan, a cross flow fan, a blower, or the like may be employed. A unit to generate an air flow is not limited to the fan device, and a compressor or a combination use of a compressor and a fan may be employed. However, an air volume needs to be adjustable by the control section 50.

(3) Separation State Detecting Section

A separation state detecting section 49 detects a state of the separation between the tip portion of the recording sheet S and the fixing belt 41 (hereinafter, may be simply referred to as "separation state"), and is made of an area sensor 45 and an illumination unit 46.

The area sensor 45 is arranged toward a direction to image the nip portion N from a slightly lower portion than a conveying path St of the recording sheet illustrated by the two-dotted chain line.

As the area sensor 45, an interline transfer (IT) type two-dimensional CCD is used in the present embodiment. The area sensor 45 can take in an image within a width V1 illustrated in FIG. 3A through the imaging lens 451 in a vertical direction, and can take in an image within a width W1 nearly equal to a sheet width (a width of the recording sheet in a direction perpendicular to a sheet passing direction, and the same is applied in the following description) as illustrated in FIG. 3B in a horizontal direction.

Note that the area sensor 45 is not limited to the above IT type CCD, and another frame interline transfer (FIT) type two-dimensional CCD, a solid-state imaging device using another CMOS, or the like may be used.

As described above, by use of the area sensor 45, the entire tip portion of the recording sheet in the sheet width direction can be imaged, and a detailed separation state about the passed recording sheet can be determined, accordingly.

Note that a resolution of the area sensor 45 may just be 300,000 pixels or more, and the number of pixels in the horizontal direction is desirably several times larger than the number of pixels in the vertical direction. This is because the imaging range in the horizontal direction (sheet width direction) is larger than the imaging range in the vertical direction.

The illumination unit 46 is desirably configured to irradiate at least a range that is the same as the imaging range of the area sensor 45. As a light source of the illumination unit 46, it is desirable to use an LED having excellent durability and energy saving properties. For example, the illumination unit 46 may be configured from a combination of one LED and a lens that diffuses light rays, or may use an LED array in which a plurality of LEDs is arranged in a main scanning direction.

However, in some cases, another light source such as a fluorescent light or an incandescent lamp may be used.

Figure 3A:
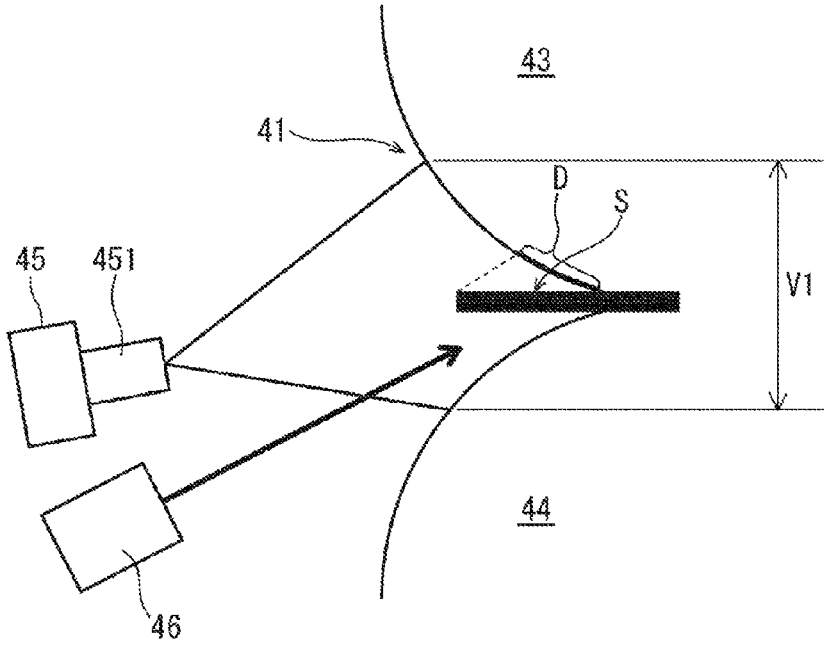
FIG. 3A is a schematic side view illustrating a state in which a nip portion of the fixing section is imaged by an area sensor.
Figure 3B:
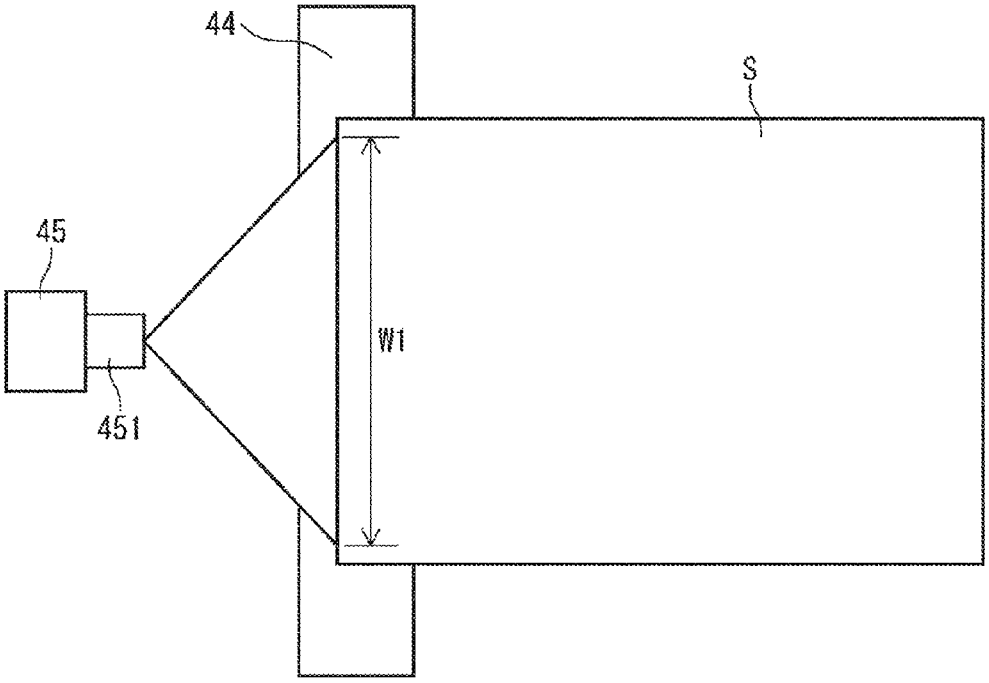
FIG. 3B is a plan view of the state.

As illustrated in FIG. 3A, the illumination unit 46 irradiates the nip portion N with light from a lower position than the area sensor 45. Therefore, a shadow D according to a protruding amount of the tip of the recording sheet S is caused in the vicinity of the nip portion N on the surface of the fixing belt 41, and detection of an edge of the recording sheet S becomes easy as described below.

(4) Determination of Separation State

Figure 4:
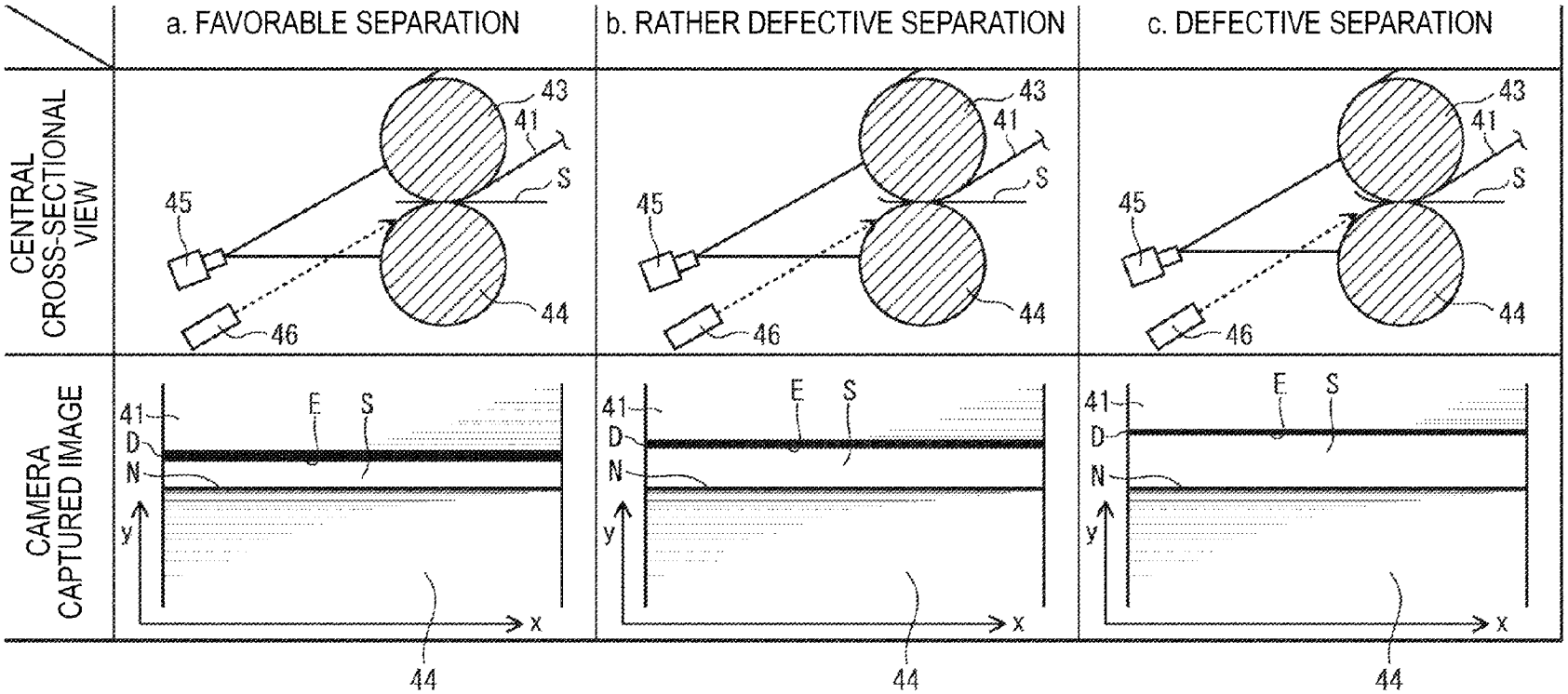
FIG. 4 is a diagram illustrating relationships between separation states of a recording sheet and a fixing belt, and captured images by an area sensor.

The upper section of FIG. 4 is central cross-sectional views (schematic views) illustrating states immediately after the tip of the recording sheet S has passed the nip portion N of the fixing section 40. The central cross-sectional views in the upper section illustrate states of the same timing after the tip of the recording sheet S has passed the nip portion N, in three stages of a. favorable separation, b. rather defective separation, and c. defective separation, according to the separation states of the recording sheet S.

The lower section of the central cross-sectional views illustrates captured images by the area sensor 45.

In the case of the left-side "a. favorable separation", the tip of the recording sheet S protrudes from the nip portion N along a sheet conveying direction. Therefore, the width of the recording sheet S in the captured image is small, and the shadow D has a relatively large width. Note that E indicates a tip edge of the recording sheet S.

However, in the case of the central "b. rather defective separation", the tip portion of the recording sheet S slightly adheres to the peripheral surface of the fixing belt 41, and is curled upward. Therefore, the width of the recording sheet S, which can be imaged by the area sensor 45, becomes large by the curling, and a distance between the edge E and the nip portion N is enlarged. Further, the width of the shadow D becomes narrow.

Further, in the case of "c. defective separation", the width of the recording sheet S in the captured image becomes larger, and the distance between the edge E and the nip portion N is enlarged.

Therefore, the control section 50 detects a position of the edge E of the recording sheet S based on the captured image of the area sensor 45, and compares a detection result and a threshold obtained in advance, using an index value (to be specific, the number of pixels in a y direction lying between the edge E and a reference position on a memory) indicating a distance between the edge E and the reference position on the image (for example, a memory address of a lowermost portion of the nip portion or the captured image), as a parameter, so that the separation state of the recording sheet S from the fixing belt 41 can be adequately determined.

(5) Configuration of Control Section

Figure 5:
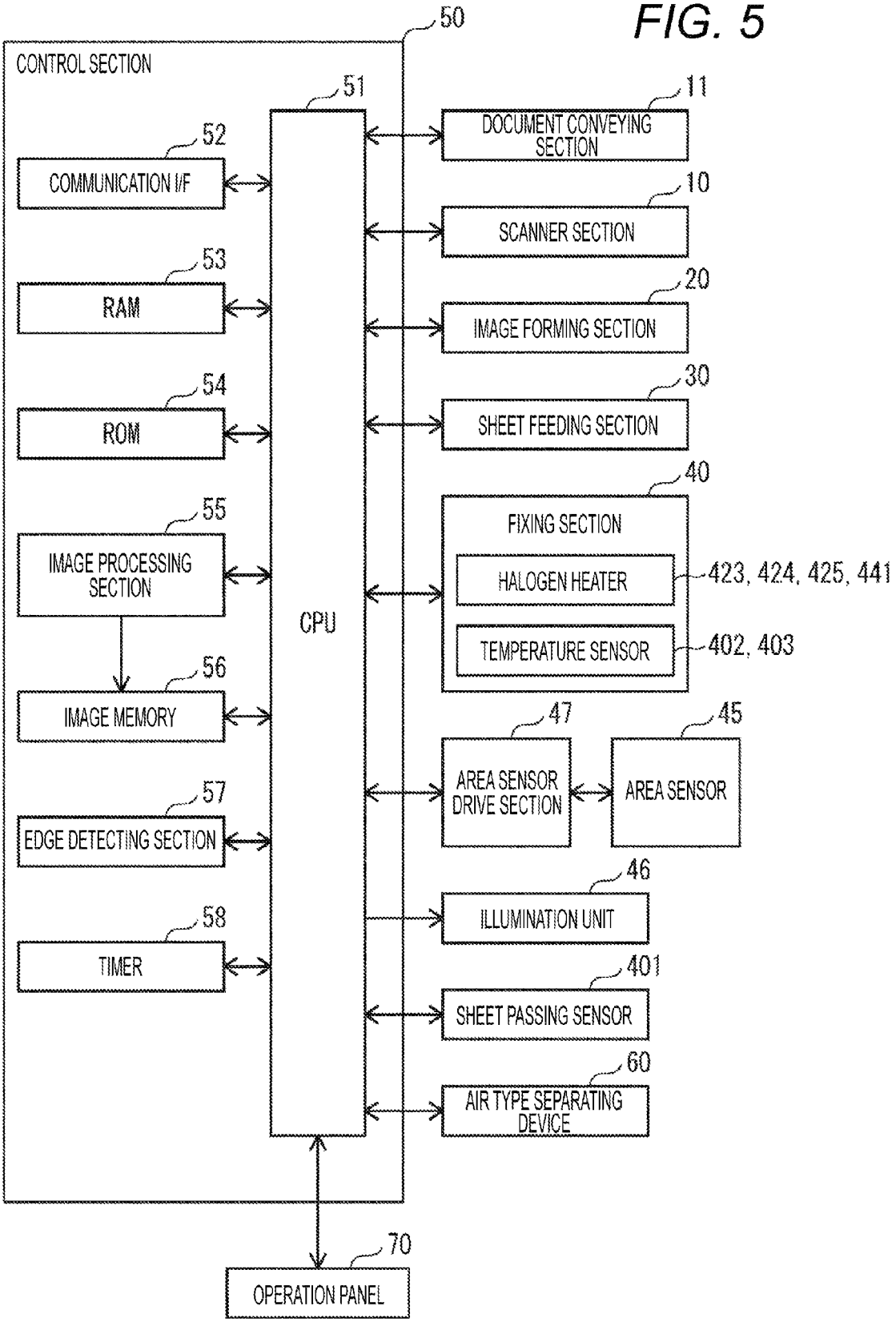
FIG. 5 is a block diagram illustrating a configuration of a control section of the copying machine according to the present embodiment.

FIG. 5 is a block diagram illustrating principal configurations of the control section 50.

As illustrated in FIG. 5, the control section 50 is made of a central processing unit (CPU) 51, a communication interface (I/F) 52, a random access memory (RAM) 53, a read only memory (ROM) 54, an image processing section 55, an image memory 56, an edge detecting section 57, a timer 58, and the like.

The CPU 51 reads a control program from the ROM 54 at the time of power ON of the copying machine 1, and executes the control program using the RAM 53 as a work memory area.

Further, the CPU 51 receives a print job from another terminal through a communication network such as a LAN, with the communication I/F 52.

Data of the print job received from the external terminal, and R, G, and B image data read in the scanner section 10 are converted into Y, C, M, and K density data, which are developing colors, in the image processing section 55, and are stored in the image memory 56 after being subjected to known image processing such as edge enhancement or smoothing processing.

The edge detecting section 57 scans the captured image by the area sensor 45 acquired through an area sensor drive section 47 to detect the edge E of the recording sheet S.

In the present embodiment, a relative position of the area sensor 45 and the illumination unit 46 is set such that the shadow D of the tip portion of the recording sheet S on the peripheral surface of the fixing belt 41 can be captured by the area sensor 45. Therefore, as illustrated in the respective captured images in the lower section of FIG. 4, differences in density between the edge E and the shadow D of the recording sheet S clearly appear.

Therefore, for example, the edge detecting section 57 sequentially obtains differences in density adjacent pixels upward (in the y direction) in the image data of the captured image in the lower section of FIG. 4, and determines the pixel of when the density difference exceeds a fixed threshold obtained in advance, as the edge portion. The edge detecting section 57 repeats this edge detection operation while moving in an x direction, whereby all pixels of the edge E are detected, and a line connecting the pixels is identified as an edge line.

However, to determine the separation state of the recording sheet S, it is not necessary to continuously obtain positions of the edge E in all in the sheet width direction, and the edge E may just be detected at appropriate intervals.

Note that the technique of edge detection is not limited to the above description, and it goes without saying that other known technologies may be used. For example, a method using a space filter such as a laplacian filter may be used.

The timer 58 determines timing of imaging by the area sensor 45. As illustrated in FIG. 2, in the sheet conveying direction, a sheet passing sensor 401 is arranged at an upper stream side of the nip portion N. After the tip of the recording sheet S is detected by the sheet passing sensor 401, timing by the timer 58 is started, and the tip of the recording sheet after a lapse of a predetermined time t1 is imaged by the area sensor 45.

This is because the determination of the separation state varies if the edge position is not detected based on the image data captured at the same timing.

Note that the predetermined time t1 is determined in advance as a time until the tip of the recording sheet protrudes from the nip portion N by a necessary amount (for example, 10 mm) to reliably detect the quality of the separation state.

As the sheet passing sensor 401, a reflection type photoelectric sensor is used in the present embodiment. The control section 50 determines that the tip of the recording sheet S has been detected, when a detection signal of the photoelectric sensor rises from OFF to ON. As the sheet passing sensor 401, another sensor, for example, a transmission type photoelectric sensor may be used.

The CPU 51 controls operations of the image forming section 20, the sheet feeding section 30, and the fixing section 40 based on image data of a document read by a scanner section 10, or the image data of the print job received from an external terminal device through the communication I/F 52, and smoothly executes a print operation.

Further, the CPU 51 determines the separation state between the recording sheet S and the fixing belt 41 based on the captured image of the tip portion of the recording sheet S obtained in the area sensor 45, controls an air volume by the air type separating device 60 according to a determination result, and executes control of reliably separating the recording sheet from the fixing belt 41.

(6) Drive Operation of Air Type Separating Device

Figure 6:
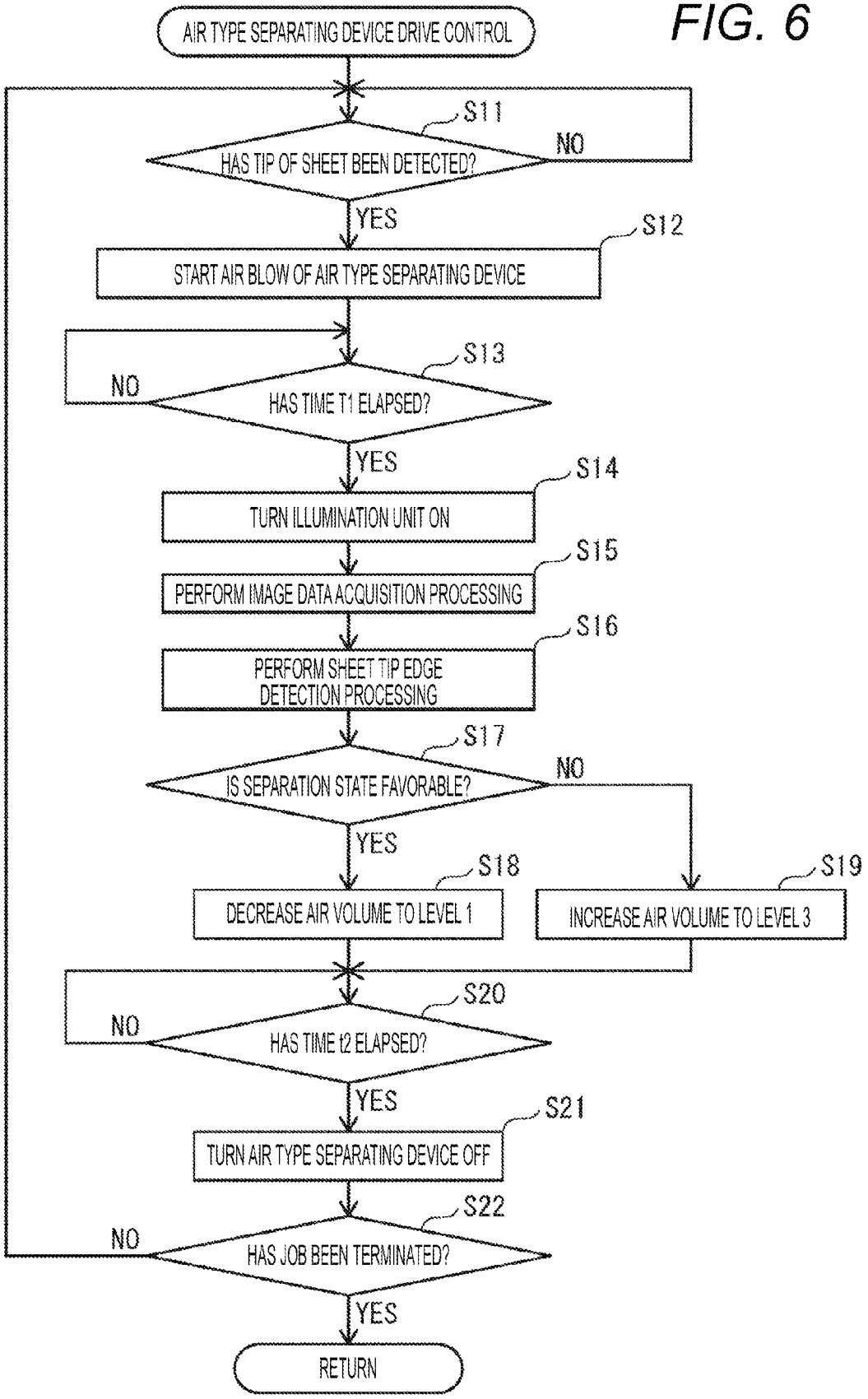
FIG. 6 is a flowchart illustrating content of drive control of an air type separating device by the control section.

FIG. 6 is a flowchart illustrating content of drive control of the air type separating device 60 executed by the control section 50. The flowchart is executed as a sub-routine of a main flowchart (not illustrated) that controls an operation of the entire copying machine 1. Note that, in the present embodiment, an A3-size sheet, which is plain paper and is longitudinally fed (the sheet is fed such that a long side is parallel to the sheet conveying direction), is used as the recording sheet having the maximum size, and the air type separating device 60 can adjust the air volume in three stages from a level 1 to a level 3.

First, the sheet passing sensor 401 (FIG. 2) determines whether the tip of the recording sheet S has been detected (step 11).

When the tip of the recording sheet S has been detected (Yes at step S11), the air volume of the air type separating device 60 is set to the level 2 and is driven (step S12).

Then, whether the time t1 seconds have elapsed after the detection of the tip of the recording sheet S by the sheet passing sensor 401 (step S13), and if the time t1 seconds have elapsed, the illumination unit 46 is turned ON only for the predetermined time, and the imaging range of the nip portion N is irradiated (step S14). This predetermined time is a necessary time for exposure of the area sensor 45 for imaging, and is about 0.001 seconds, for example.

The captured image of the area sensor 45 at that time is transferred to the CPU 51 through the area sensor drive section 47, and the CPU 51 acquires imaged data around the nip portion N (step S15).

The imaged data is temporarily stored in the RAM 53, and the edge detecting section 57 executes the above-described sheet tip edge detection processing (step S16).

Whether the separation state between the fixing belt 41 and the recording sheet S is favorable is determined at step S17 based on the positional information of the detected edge E.

In the present embodiment, the edge positions are detected in 18 positions equally divided in the sheet width direction (the x direction of FIG. 4) in the sheet tip edge detection processing, and only when the separation state is determined to be favorable in all of the positions, the determination is made YES at step S17.

At step S17, when the separation state is determined to be favorable (YES at step S17), the air volume of the air type separating device 60 is decreased to the minimum level 1 (step S18).

On the other hand, when the separation state is determined to be unfavorable (NO at step S17), the processing is moved onto step S19, and the air volume of the air type separating device 60 is increased to the maximum level 3, and separation power by air blow is strengthened.

Following that, when a measured time by the timer passes a time t2 (YES at step S20), the air type separating device 60 is turned OFF (step S21). This time t2 is a value obtained by an experiment or the like in advance, as a time in which the tip of the recording sheet S after fixation is reliably guided by a guiding member (not illustrated) at the downstream side of the nip portion N of the fixing section 40, and a jam no longer occurs.

Then, whether the job (a copy job or a print job) has been terminated is determined (step S22). When the job has been terminated (YES at step S22), the processing is returned to the main flowchart. When the job has not been terminated (NO at step S22), the processing of steps S11 to S21 is repeated until when the job is terminated.

As described above, according to the present embodiment, the edge is detected based on the captured image in the vicinity of the nip portion N obtained by the area sensor 45, and the separation state is determined. Therefore, the present embodiment can precisely recognize the state immediately after the tip of the recording sheet S has passed the nip portion N, and is excellent in determination accuracy.

Then, when the separation state is favorable, the air volume is decreased to the level 1, and only when the separation state is not favorable, the air volume is increased to the level 3. Therefore, the power supplied to the fan device, and the power necessary for supplementing the heat amount taken by the air blow to maintain the fixing temperature can be reduced, compared with a case of blowing the air at the level 3 on the steady basis, thinking the worst case. Therefore, the present embodiment contributes to power saving.

Modification

The present invention has been described based on the embodiment. However, it is apparent that the present invention is not limited to the embodiment, and modifications below can be considered.

(1) A relative positional relationship between an area sensor 45 and an illumination unit 46, and a sheet conveying path St, after a nip portion N is passed is not limited to the case of FIG. 2 of the above-described embodiment.

In essence, the illumination unit 46 and the area sensor 45 may just be arranged in a relative position in which the illumination unit 46 can perform irradiation with light, from a direction in which a shadow of the tip of the recording sheet S immediately after the tip of the recording sheet S has passed the nip portion N can be moved on a peripheral surface of a rotating body at a side to which the recording sheet S adheres and approaches (a direction of illuminating a back surface of a tip portion of the recording sheet that approaches the rotating body), and the area sensor 45 can capture the edge portion of the recording sheet S and the shadow of the edge portion.

This is because a difference of light and shade in an edge portion becomes remarkable on image data, and an edge of the tip portion of the recording sheet can be reliably detected.

Figure 7:
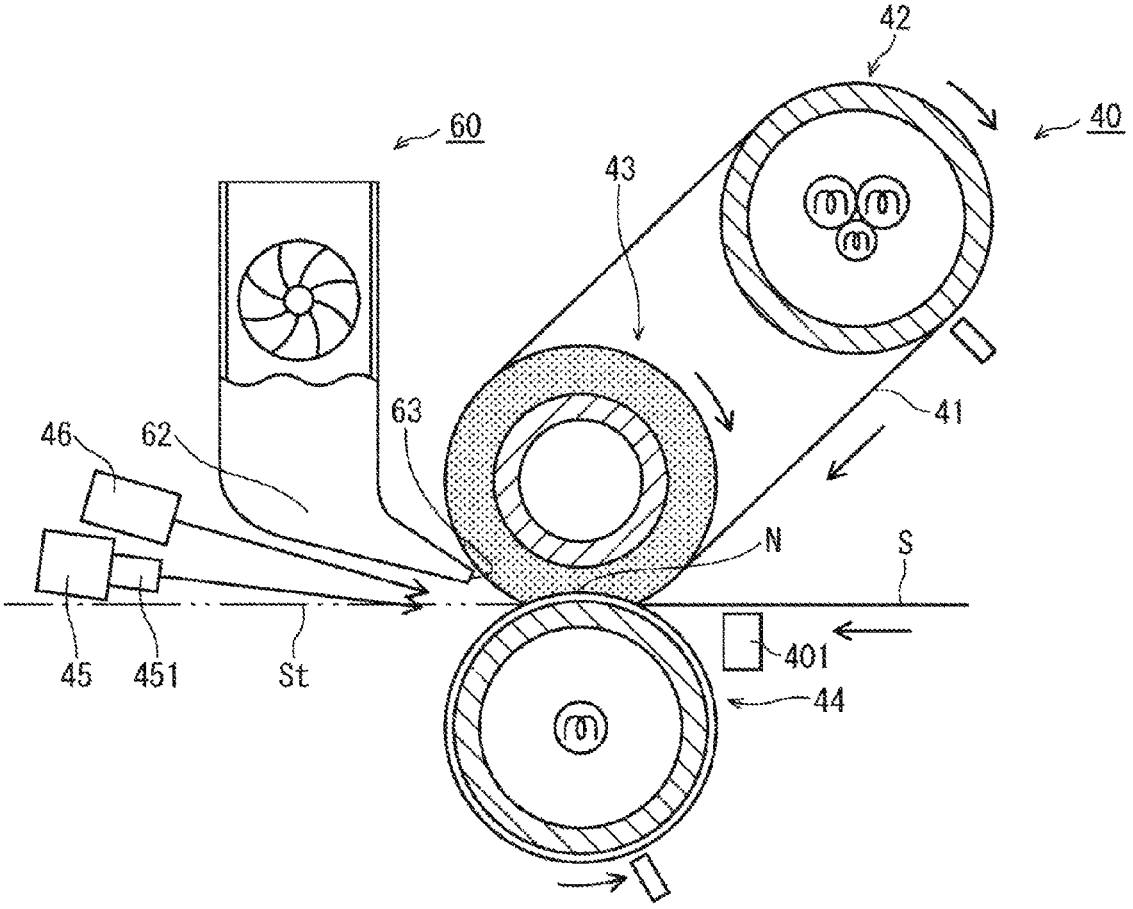
FIG. 7 is a diagram illustrating another arrangement example of the area sensor and an illumination unit.

Further, if space allows, the area sensor 45 may image the nip portion N from slightly above (about 15°) the sheet conveying path St, and the illumination unit 46 may irradiate the nip portion N from a position above the area sensor 45 and as close as possible to the area sensor 45, as illustrated in FIG. 7, for example.

With the positional relationship, the illumination unit 46 irradiates an end surface (edge surface) of the tip portion of the recording sheet, and a picture of the irradiation can be imaged by the area sensor 45.

Especially, in a case of "b. rather defective separation", light from the illumination unit 46 incident from a nearly front to the end surface of the tip portion of the recording sheet bent slightly upward along a peripheral surface of a fixing belt 41 is reflected in a manner close to specular reflection at the end surface, and is incident to the area sensor 45. Therefore, luminance of the portion especially becomes high in imaged data, and the edge portion can be easily detected.

Figure 8:
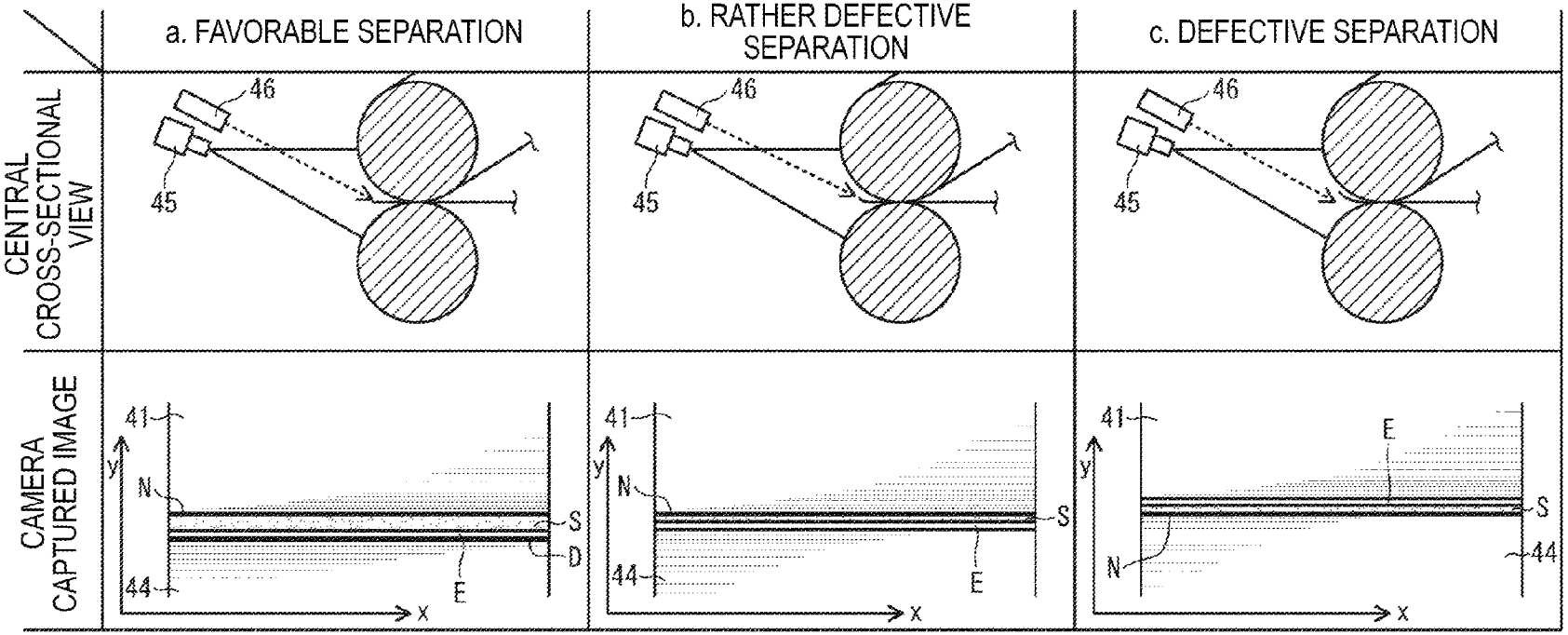
FIG. 8 is a diagram illustrating relationships between separation states of a recording sheet and a fixing belt, and captured images by the area sensor based on an arrangement example of the area sensor and the illumination unit 46 of FIG. 7.
Figure 9A:
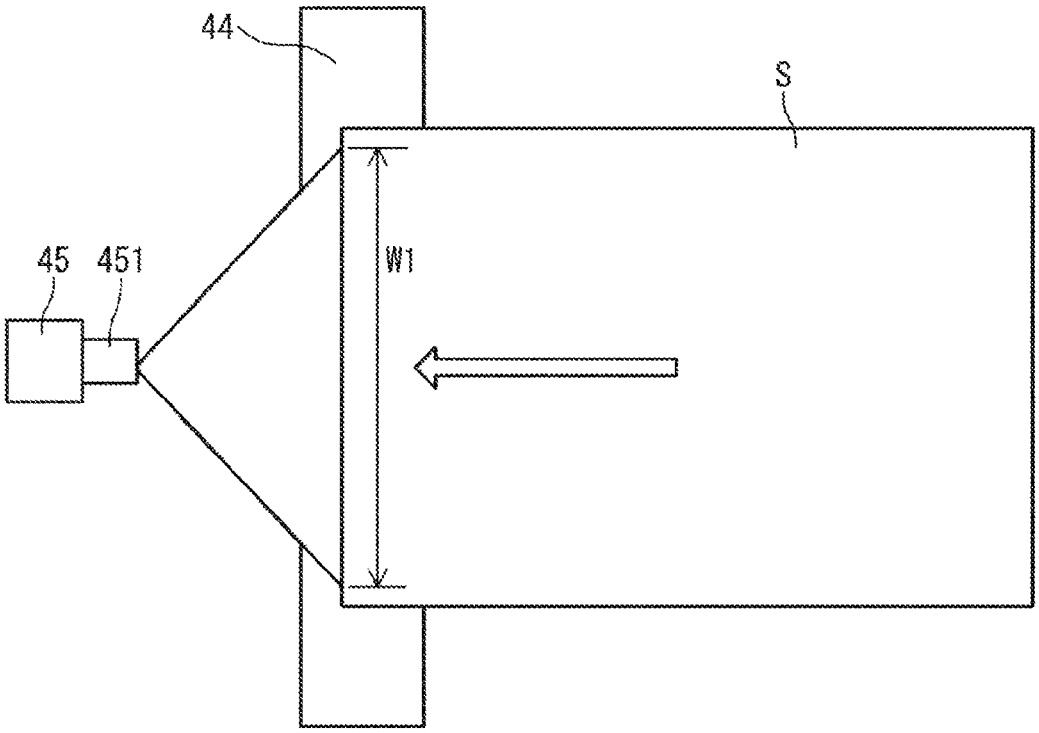
FIGS. 9A and 9B are plan views for describing a modification in which an imaging range is changed according to a size of a width of a sheet to be passed to a fixing section.
Figure 9B:
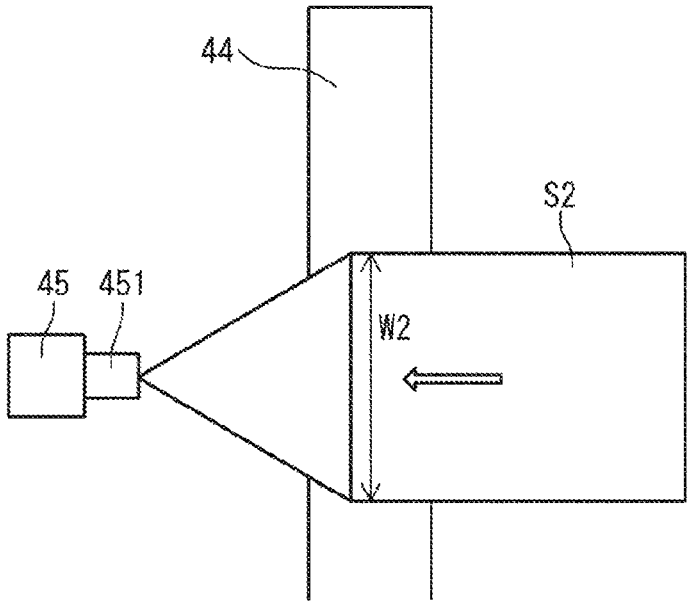

The lower section of FIG. 8 illustrates examples of imaged images in the present modification. Brightness of an edge surface E is higher than other places, and the edge can be easily detected. Note that, in reality, the thickness of the recording sheet is about 80 to 100 μm in a plain paper, and thus FIG. 8 illustrates the thickness of the end surface of the recording sheet in an exaggerated manner.

Apparently, even in this case, the position of the edge of the tip portion of the recording sheet S varies depending on the separation state of the sheet. Therefore, the separation state of the sheet can be easily determined as long as the edge position can be detected.

In addition, a shadow D of the tip portion of the recording sheet may not always be able to be imaged, or the end surface of the recording sheet may not be able to be imaged, depending on the positional relationship between the area sensor 45 and the illumination unit 46. However, the edge on the image data can be detected if the color or the brightness of the peripheral surfaces of the fixing belt 41 and the pressure roller 44 can be sufficiently distinguished from the color (white in most cases) of the recording sheet.

(2) In the above embodiment, the case in which the width of the passed recording sheet is constant has been described. However, if the width of the recording sheet is small, the edge of the recording sheet cannot be detected from a captured image that does not include the recording sheet. Therefore, an error may occur.

To avoid such inconvenience, information related to the width of the recording sheet is acquired in advance, and image data within a certain range of the recording sheet is cut from image data of the entire captured image acquired in a control section 50 based on the information, and edge detection processing may just be performed.

However, in this case, useless captured image, which is not to be subjected to the edge detection processing, is taken in to the control section 50 once. Therefore, a transfer time becomes long.

Therefore, in the present modification, the range of the image data to be taken in to the control section 50 through an area sensor drive section 47, of the entire range of the image that can be imaged by an area sensor 45, can be changed in accordance with the sheet width of the recording sheet that is actually passed.

As a technology of acquiring image data within a necessary range determined in advance, of the entire imagable image range, a partial scan (registered trademark) technology (hereinafter, referred to as "partial scan" in the present specification), which is disclosed in the publication of JP 2008-42838 A or JP 2011-151468 A, can be used.

As is well known, the two-dimensional CCD used as the area sensor 45 in the present embodiment has a configuration in which electric charges of a plurality of photodiodes arrayed in a matrix manner are transferred to corresponding vertical transfer CCDs through transfer gates, the electric charges in the vertical transfer CCDs of each column are transferred by one pixel at a time toward the horizontal transfer CCD, for each vertical transfer pulse, and the horizontal transfer CCDs transfer the electric charges transferred from the vertical transfer CCDs, by one pixel for each horizontal transfer pulse in the horizontal direction, to send out and output the electric charges to an electric charge detection section. Electrical signals corresponding to all of the pixels can be obtained by repetition of the vertical transfer and the horizontal transfer.

Usually, the vertical transfer pulse and the horizontal transfer pulse occur at a fixed period. However, according to a partial scan method in the above-described publications, it is configured to sweep out, at a high speed, the vertical transfer pulse/horizontal transfer pulse of when the electric charges of pixels within an unnecessary range are transferred, by making the period faster than a period of a normal transfer pulse (to be specific, about 1/10), and to transfer and read the electric charges of the pixels within a necessary range at a normal pulse period.

Accordingly, a transfer time can be substantially shortened, compared with a case where the electric charges of the pixels of the entire area sensor 45 are read, and the separation state can be more promptly detected.

Figure 10:
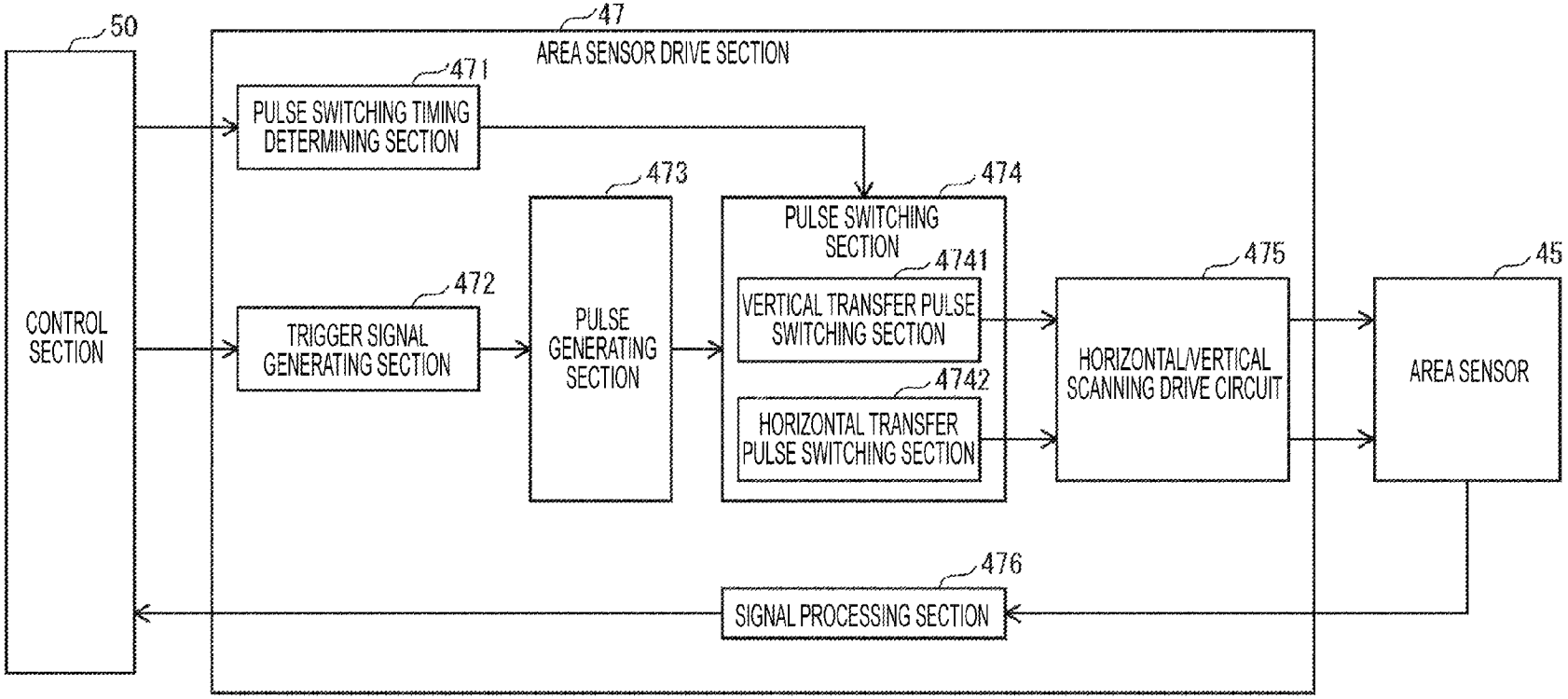
FIG. 10 is a block diagram illustrating a configuration of an area sensor drive section in reducing the imaging range and performing partial scan.

FIG. 10 is a block diagram illustrating a configuration example of the area sensor drive section 47 for implementing the partial scan in the present embodiment.

As illustrated in FIG. 10, the area sensor drive section 47 includes a pulse switching timing determining section 471, a trigger signal generating section 472, a pulse generating section 473, a pulse switching section 474, a horizontal/vertical scanning drive circuit 475, and a signal processing section 476.

The pulse switching timing determining section 471 acquire information related to the sheet width of the recording sheet passed from the control section 50, and determines timing to switch the horizontal transfer pulse and the vertical transfer pulse between the high speed and the normal period. Therefore, the pulse switching timing determining section 471 includes a table (not illustrated) in which the sheet width of the passed recording sheet, and information related to timing (the number of pulses from the start of transfer or timing defined in time) to switch each respective pulse in the case of the sheet width are associated with each other.

The trigger signal generating section 472 generates a trigger signal according to an instruction from the control section 50, and causes the pulse generating section 473 to generate a basic pulse.

The pulse switching section 474 includes a vertical transfer pulse switching section 4741 and a horizontal transfer pulse switching section 4742. The pulse switching section 474 switches the vertical transfer pulse and the horizontal transfer pulse in the normal period to be used at the time of transfer of the electric charges of pixels to be respectively partially scanned, and the vertical transfer pulse and the horizontal transfer pulse at the high speed used at the time of transfer of the other pixels to be discarded, at timing determined in the pulse switching timing determining section 471.

The horizontal/vertical scanning drive circuit 475 causes the area sensor 45 to scan in the horizontal/vertical directions based on the horizontal/vertical transfer pulses output from the pulse switching section 474.

The signal processing section 476 processes a picture signal output from the area sensor 45 to be converted into a digital signal.

Note that it is configured that an unnecessary image signal swept out from the horizontal transfer CCD during the transfer with the high speed pulse is swept out to a reset drain through a reset gate provided in a horizontal electric charge detecting section in the area sensor 45. Only the image signal to be partially scanned is output to the signal processing section 476.

Alternatively, an unnecessary picture signal may be discarded in the signal processing section 476 or the like without sweeping out, by the reset gate in the area sensor 45, the unnecessary electric charges transferred at the high speed.

Figure 11:
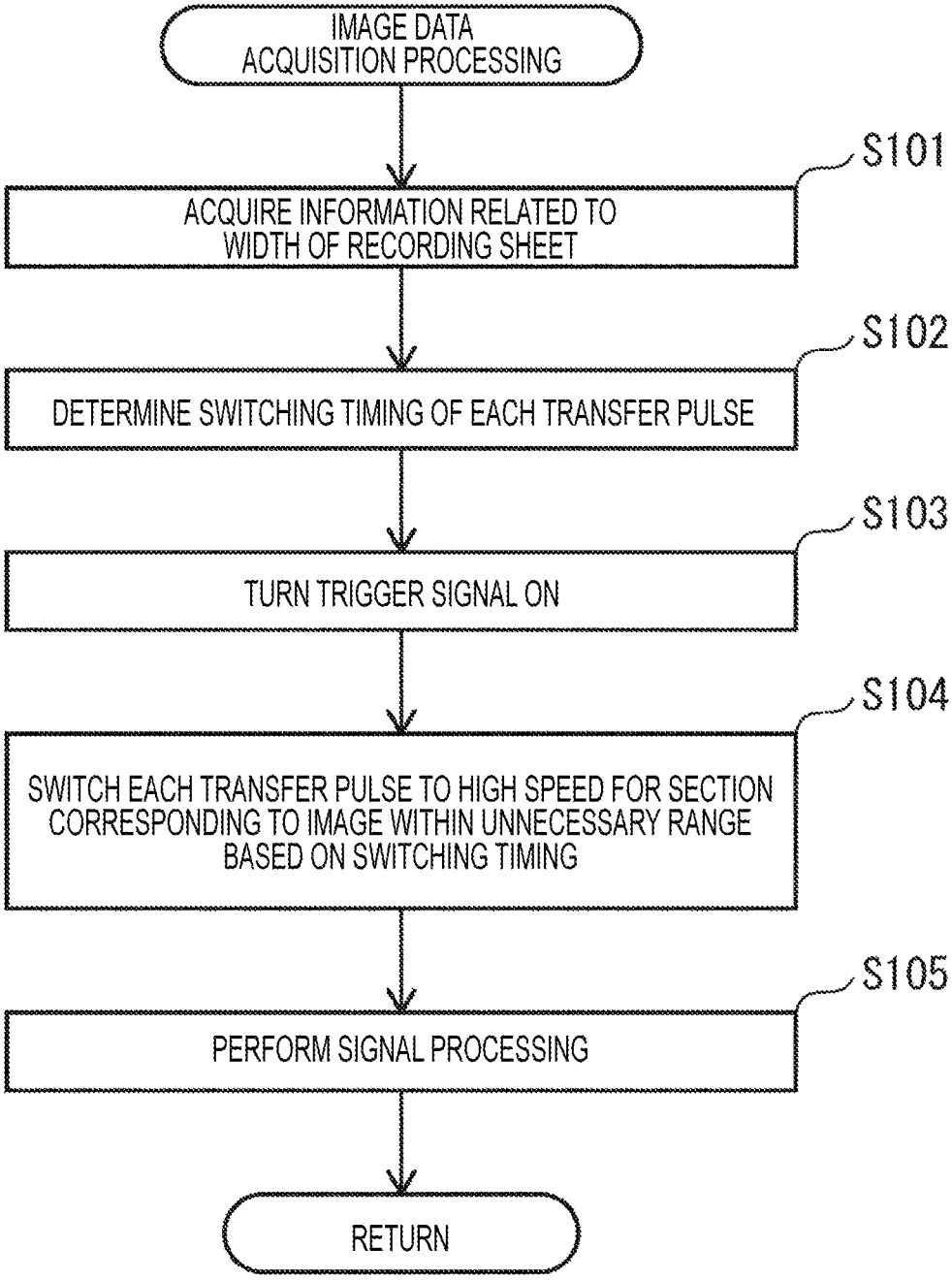
FIG. 11 is a flowchart illustrating a sub-routine of image data acquisition processing of step S15 of FIG. 6 of when the partial scan is executed.

FIG. 11 is a flowchart illustrating a sub-routine of image data acquisition processing (corresponding to step S15 of FIG. 6) in the present modification.

The control section 50 recognizes the sizes of recording sheets S respectively stored in sheet feeding cassettes 31 to 33 in advance, and acquires the sheet width of the recording sheet to be fed based on a sheet feed port specified by a user through an operation panel 70 (see FIG. 5), or a sheet feed port specified in control information in a header of data of a print job received from an external terminal (step S101).

The pulse switching timing determining section 471 determines the timing to switch the period of each transfer pulse based on the information, and notifies the pulse switching section 474 of the timing (step S102).

Then, the trigger signal generating section 472 turns the trigger signal ON (step S103), and the pulse generating section 473 generates the basic pulse.

The pulse switching section 474 switches the vertical/horizontal transfer pulses to the high speed, in a section corresponding to the image within the unnecessary range, of the captured image, based on the switching timing determined in the pulse switching timing determining section 471, and the horizontal/vertical scanning drive circuit 475 drives and scans the area sensor 45 (step S104). The signal processing section 476 processes only the signal of the pixel within the necessary range to be converted into a digital signal, and transmits the digital signal to the control section 50, as image data (step S105).

By execution of the partial scan as described above, only the image data within the range in which determination of quality of the separation state is necessary can be promptly read.

(3) The above-described modification (2) has described the configuration of executing the partial scan to change the imaging range to be acquired according to the change of the size of the sheet width. However, an imaging range in a sheet width direction may be changed according to a situation of a separation state, for recording sheets having the same size.

Figure 12A:
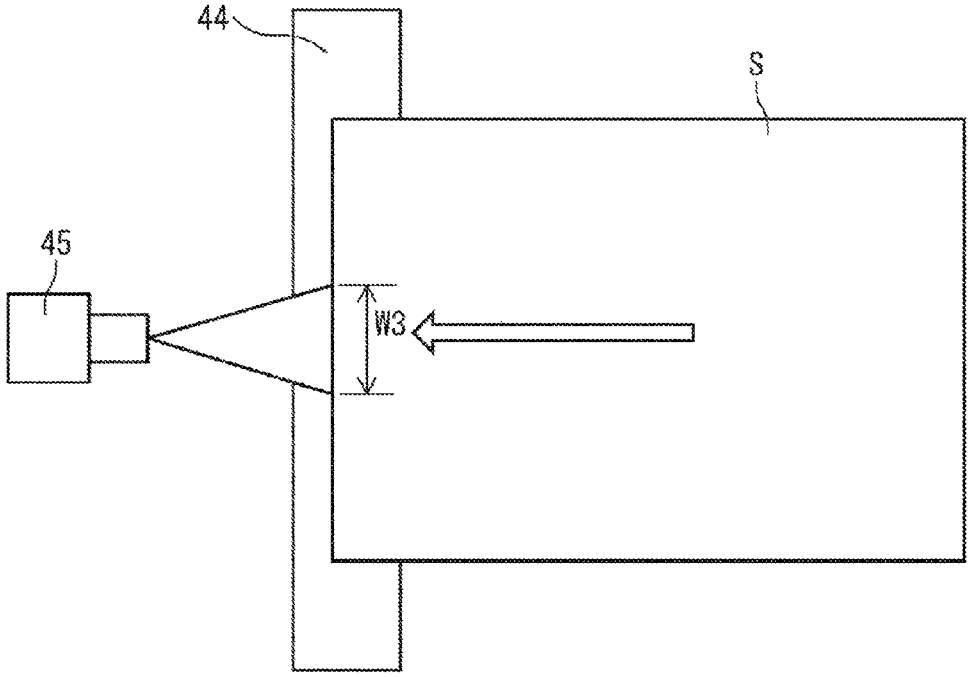
FIGS. 12A and 12B are plan views illustrating a modification of a case in which an imaging range in a sheet width direction of an area sensor is narrowed in an initial stage of execution of a print job, and the imaging range is enlarged when a separation state of a sheet is deteriorated, for recording sheets having the same sheet width.
Figure 12B:
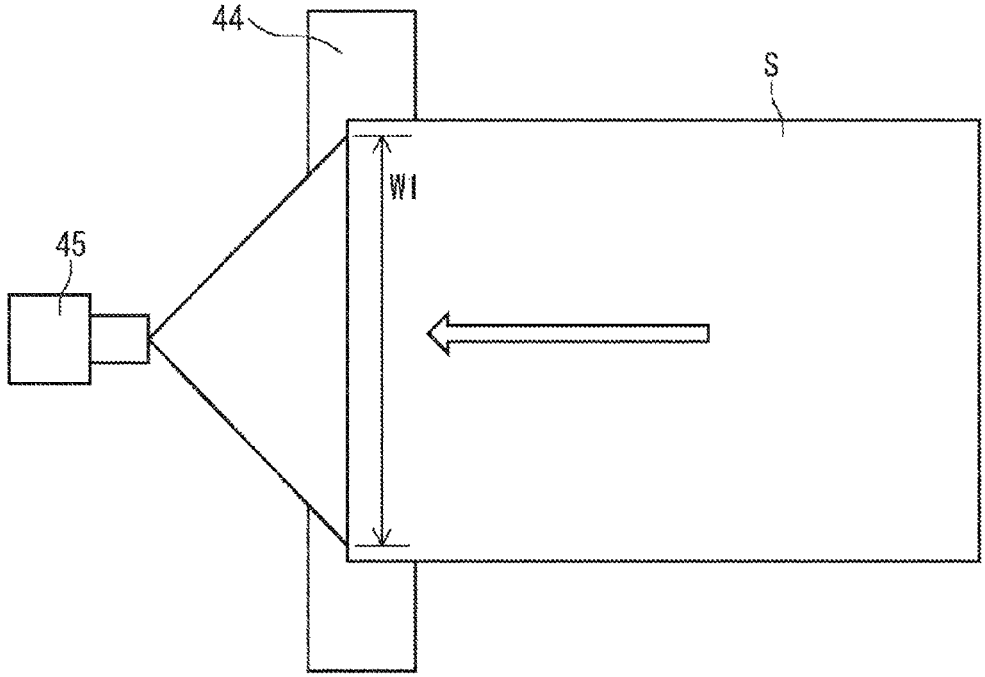

That is, in a case where a print job or a copy job (hereinafter, simply referred to as "job") to sequentially perform printing on a plurality of recording sheets is received, and when a separation state of a recording sheet is determined first, only a partial area W3 of a central portion in a sheet width direction is partially scanned, as illustrated in FIG. 12A, and a separation state is determined from a picture of the area. When the separation state is determined to be more likely to be deteriorated, from a history of the determination, a nearly entire area W1 of the sheet width is imaged, as illustrated in FIG. 12B, and the separation state may be more carefully determined.

Figure 13:
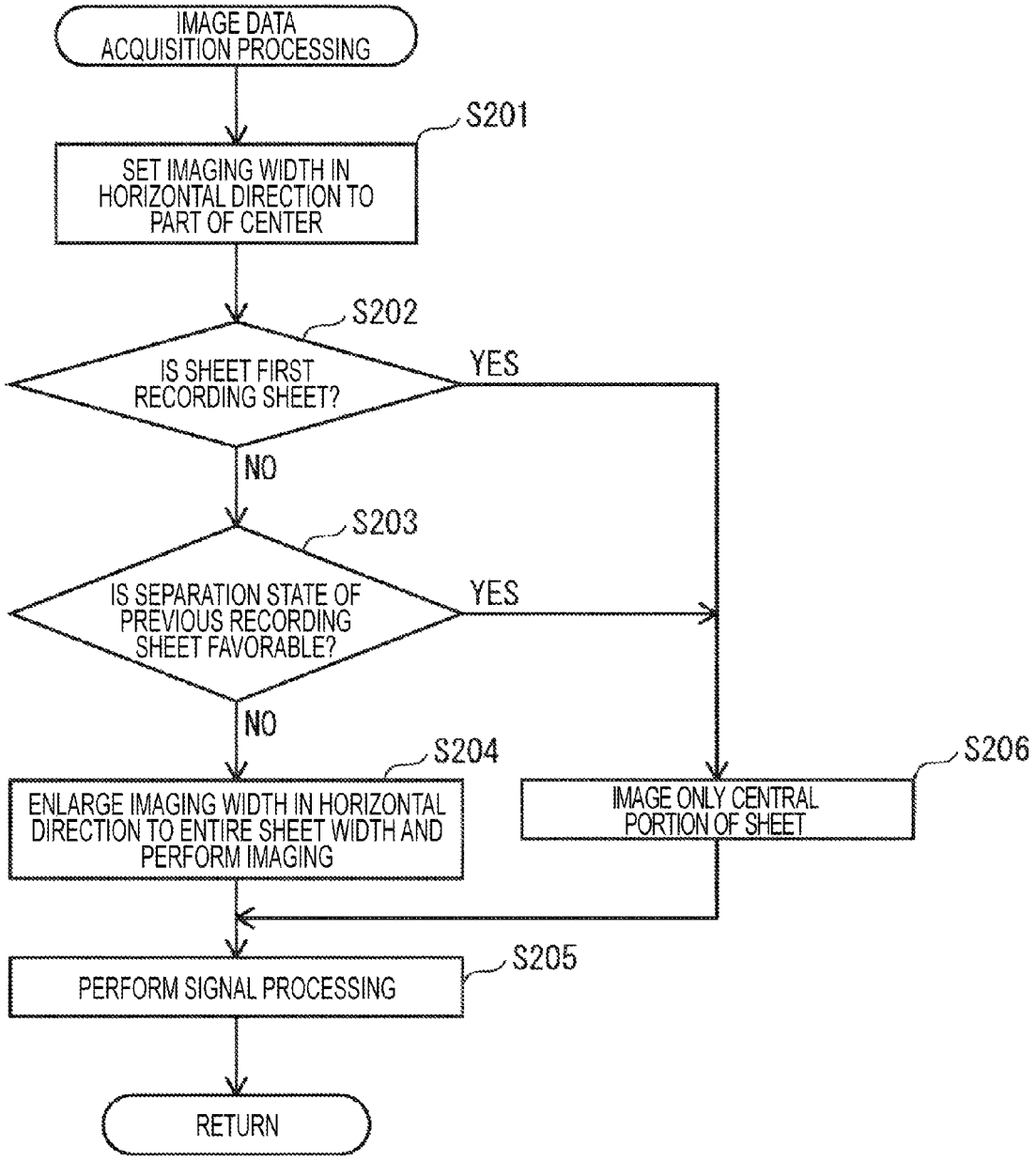
FIG. 13 is a flowchart illustrating a sub-routine of image data acquisition processing executed in a control section in the modification of FIG. 12.

FIG. 13 is a flowchart illustrating a sub-routine of image data acquisition processing in the present modification.

First, the imaging range of a recording sheet S in a horizontal direction is set to apart (the range W3) of the center (step S201).

Then, whether the sheet to be passed is the first recording sheet in the job is determined (step S202), if so (YES at step S202), the imaging range W3 is partially scanned as it is, and a captured image is acquired (step S206).

That is, information related to the imaging range is transmitted from a control section 50 to an area sensor drive section 47, and the area sensor drive section 47 switches horizontal/vertical transfer pulses at a normal speed and a high speed, by a method similar to the above-described method, and partially scans only the range of the central portion.

If the sheet to be passed next is not the first sheet, and is the second or a subsequent sheet (NO at step S202), and the separation state of the previously passed recording sheet is not favorable (NO at step S203), the imaging width in the horizontal direction is enlarged to the nearly entire area W1 of the sheet width, and the imaging is executed (step S204).

Further, at step S203, when the separation states of the second and the subsequent recording sheets S are determined to be favorable (YES at step S203), the partial scan is executed while keeping the imaging range W3 as it is (step S206).

An image signal obtained in the imaging at step S204 or S206 is processed at step S205. Following that, the processing is returned to the flowchart of FIG. 6.

As described above, in the present modification, only the image of the partial area of the recording sheet S in the width direction is acquired by the partial scan at the initial stage, and an edge of only the image of the partial area is detected and the separation state is determined. Therefore, prompt determination of the separation state can be realized. Further, there are advantages that a load of the control section 50 to the processing of a CPU 51 can be decreased, and power consumption can be reduced.

Then, when the separation state of the partial area is getting not favorable, there is a probability that the separation state in another place in the width direction of the recording sheet S may become deteriorated. Therefore, the present modification is configured to set the entire sheet width as an object to be monitored, thereby to more reliably prevent a trouble such as a jam.

(4) In the above-described modification (3), the imaging range is changed in the sheet width direction. However, the present modification has a characteristic in that an imaging range in a vertical direction is changed.

Figure 14A:
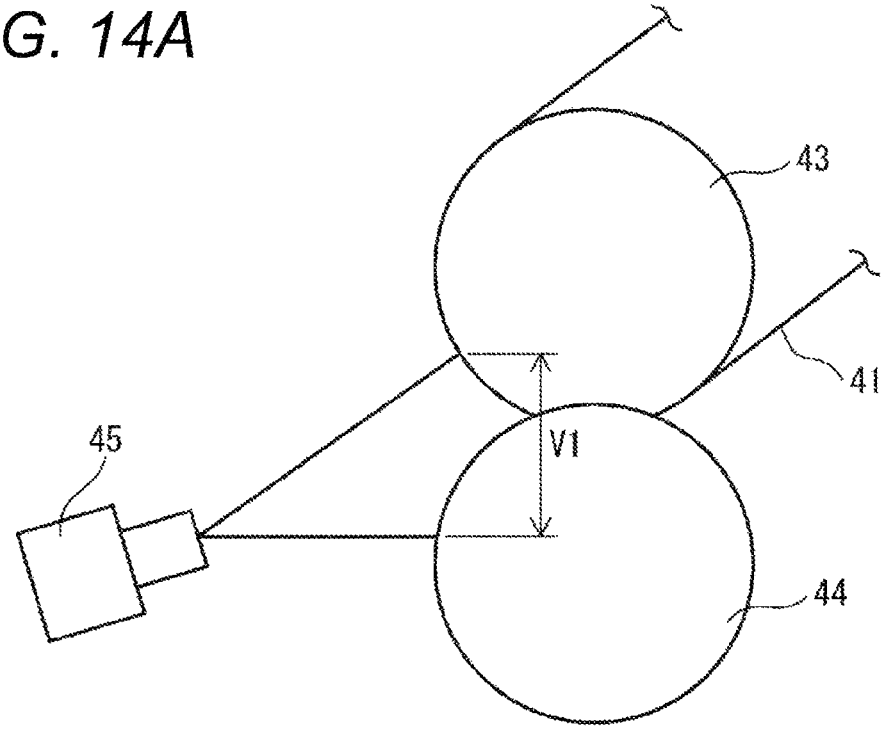
FIGS. 14A and 14B are plan views illustrating a modification in a case in which an imaging range of an area sensor in a vertical direction is increased in an initial stage of execution of a print job, and the imaging range is reduced in the vertical direction and partial scan is performed when a favorable state of a separation state of a sheet is continued.
Figure 14B:
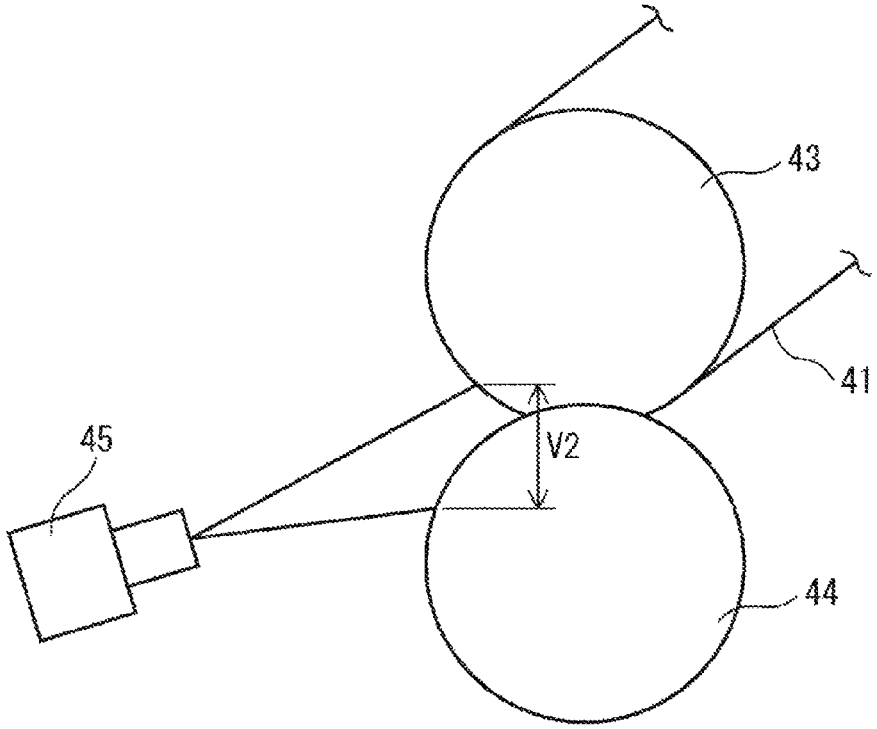

That is, normally, in the vertical direction, as illustrated in FIG. 14A, an imaging width in the vertical direction is set to a maximum imagable width V1 (first imaging width) so that the imaging can be performed even in a worst separation state. When the separation state is predicted to be favorable, the imaging range in the vertical direction is narrowed to a width V2 (second imaging width), as illustrated in FIG. 14B, and the partial scan is performed.

Figure 15:
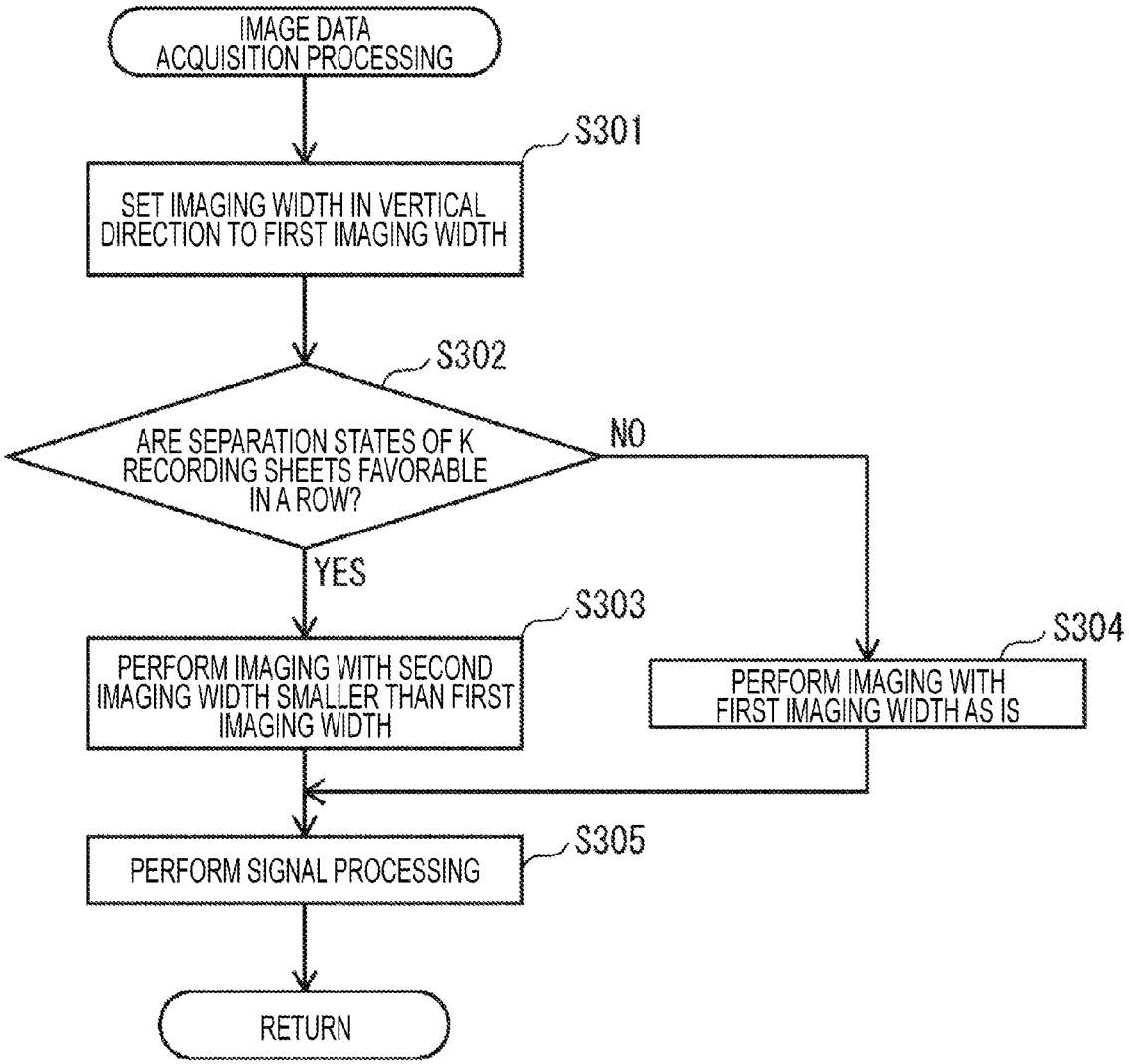
FIG. 15 is a flowchart illustrating a sub-routine of image data acquisition processing executed in a control section in the modification of FIG. 14.

FIG. 15 is a flowchart illustrating content of a sub-routine of image data acquisition processing executed in a control section 50 in the present modification.

First, the imaging width with an area sensor 45 in the vertical direction is set to the first imaging width (V1) (step S301).

Then, whether the separations states of K recording sheets are favorable in succession from the start of the print job (step S302).

Here, K is a numerical value by which it can be predicted that the separation states of subsequent recording sheets will be no longer deteriorated because the separation states of the K recording sheets are favorable in succession from the start of the print job, according to image forming conditions of the print job (firmness of the recording sheet, a type of image data to be printed, and the like). K can be empirically obtained from an experiment or the like in advance (K is ten, for example).

Note that, when the print job being in execution is less than K recording sheets, and all of the separation states are favorable, "NO" is always determined at step S302 until the end of the print job.

When the separation states of K recording sheets are favorable in succession from the start of the print job (YES at step S302), the separation state is predicted to be favorable and a tip of the recording sheet S is predicated to fall within a predetermined range, in the future. Therefore, the imaging width of the area sensor 45 in the vertical direction is set to the second imaging width (V2) that is smaller than the first imaging width, and imaging (partial scan) is performed (step S303).

Accordingly, it becomes necessary to perform signal processing and edge detection processing of a useless range, and the separation state of the recording sheet S can be more promptly determined and contribution to a decrease in power consumption can be made.

On the other hand, when the favorable determination of the K recording sheets are made in succession from the start of the print job (NO at step S302), the imaging width of the area sensor 45 in the vertical direction is kept to the wide first imaging width for safety, and imaging is performed (step S304).

Then, at step S305, the signal processing is performed for an image signal obtained at step S303 or S304, and the processing is returned to the flowchart of FIG. 6.

Note that, in the present modification, the first imaging width (V1) is the maximum imaging width in the area sensor 45 in the vertical direction. However, the first imaging width (V1) is not necessarily the maximum width as long as within a range in which a tip portion of the sheet can be imaged even in a case where the separation state of the tip portion of the recording sheet is worst.

Further, when it is turned out that the separation state becomes deteriorated after the imaging range of the area sensor 45 in the vertical direction is switched to the second range, it may be configured to return the imaging range to the first range.

(5) In the above-described embodiment, the width of a blow-out port of the nozzle of the air type separating device 60 in an axial direction of the fixing roller 43 is the same as the maximum sheet width of the sheet passed to the fixing section 40, and when the separation state is determined to be unfavorable even in one place in the sheet width direction in the determination of the separation state, the air for separation is blown to the entire sheet width. However, the present modification is configured to blow the air only to a place that requires separation.

Figure 16:
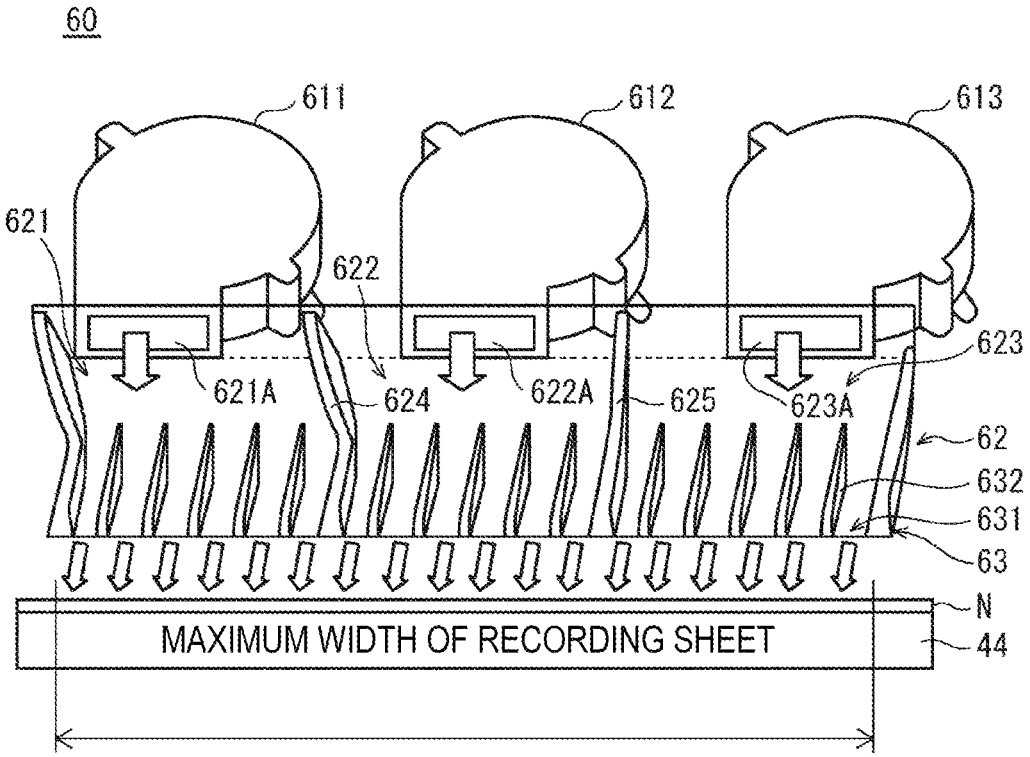
FIG. 16 is a schematic diagram illustrating a configuration of a modification of an air type separating device.

FIG. 16 is a schematic diagram illustrating a configuration of an air type separating device 60 according to the present modification. A duct 62 portion is illustrated in a state in which a side plate of a front side in the drawing is removed for easy understanding of an internal structure.

As illustrated in the drawing, in the air type separating device 60 according to the present modification, an interior of the duct 62 is divided into three sub-ducts 621, 622, and 623 with partition walls 624 and 625, and air-blow ports of fan devices 611 to 613 are connected to openings 621A to 623A of the respective sub-ducts.

Further, a nozzle portion 63 at tips of the sub-ducts 621 to 623 is divided into each six small nozzles 631 with a plurality of partition walls 632, and is in a state in which a total of 18 small nozzles 631 are arranged along the sheet width of the maximum size.

Further, an opening/closing mechanism that opens/closes the air blow-out port is provided in each of the small nozzles 631.

Figures 17, 18:
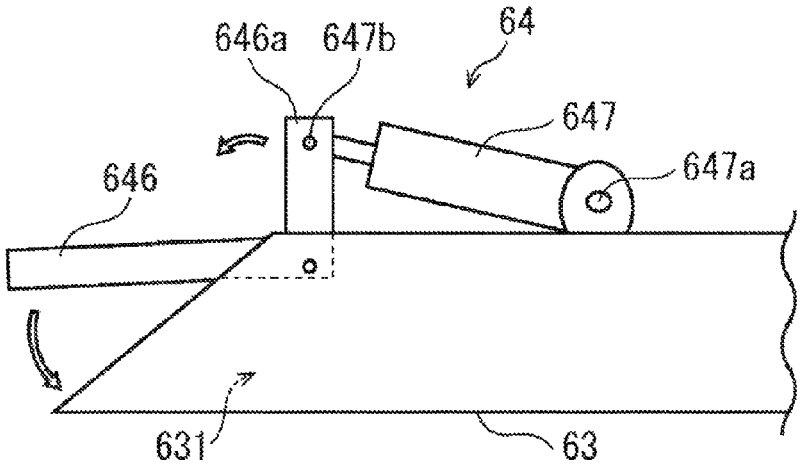
FIG. 17 is a diagram illustrating a configuration example of an opening/closing mechanism in a tip portion of each small nozzle in the air type separating device according to the modification of FIG. 16.
FIG. 18 is a table illustrating quality of the separation state of the recording sheet in positions corresponding to tip portions of respective small nozzles in the air type separating device according to the modification of FIG. 16.

FIG. 17 is a schematic view of when the nozzle portion 63 of the duct 62 is viewed from a right direction of FIG. 16, for describing a configuration of an opening/closing mechanism 64.

As illustrated in FIG. 17, the opening/closing mechanism 64 is made of a cover member 646 swingably provided on an opening portion of the tip of the small nozzle 631, a swing lever 646*a* attached to the cover member 646, and an actuator 647 having a base end portion swingably supported to the small nozzle 631 with a support shaft 647*a*, and a tip of a rod portion connected to an end portion of the swing lever 646*a* with a pin 647*b*.

The swing lever 646*a* is tilted by the actuator 647 to a left direction in the drawing, so that the small nozzle 631 is covered with the cover member 646.

Note that a solenoid is used as the actuator 647, for example. However, the actuator 647 is not limited thereto. Any mechanism can be employed as long as the mechanism is a motor-and-cam mechanism or a combination of the motor-and-cam mechanism and a crank mechanism, and swings and drives the cover member 646.

The air can be selectively blown to a portion with an unfavorable separation state with the fan devices 611 to 613, and the opening/closing mechanisms 64 provided on the opening portions of the tips of the respective small nozzles 631. Accordingly, a case of wastefully taking heat of a fixing belt 41 and a fixing roller 43 by blowing the air to a portion with a favorable separation state and not requiring air separation can be eliminated. Therefore, contribution to energy saving can be made.

For example, an edge portion of the recording sheet is detected at positions corresponding to the 18 small nozzles 631 and the separation states are determined with image data imaged by an area sensor 45, and the air is controlled to blow out through the corresponding small nozzle 631 in the place where the separation state is determined to be unfavorable.

Hereinafter, for convenience of description, sections in the sheet width direction, which correspond to widths of the respective small nozzles 631 are "P1 to P18" from the left end in FIG. 16 (see FIG. 19).

FIG. 18 is a table illustrating an example of determination results of the separation states in the respective sections P1 to P18.

In the present embodiment, the air is blown only when the separation state is not favorable. In the table of FIG. 18, "1" is stored in a place where the separation state is determined to be favorable (air separation is unnecessary), and "2" is stored in other cases (air separation is necessary).

Note that the separation state of each section may be determined by detection of an edge position of the recording sheet only in one place (for example, a central portion) in the appropriate section, or edge positions in two or more of a plurality of places in each section is detected and if the separation state is not favorable even in one place, the separation state of the section may be determined to be unfavorable.

Driving of the fan devices 611 to 613 and the opening/closing operations by the opening/closing mechanisms 64 in the small nozzles 631 are controlled by a control section 50 based on the table of FIG. 18.

Figure 19A:
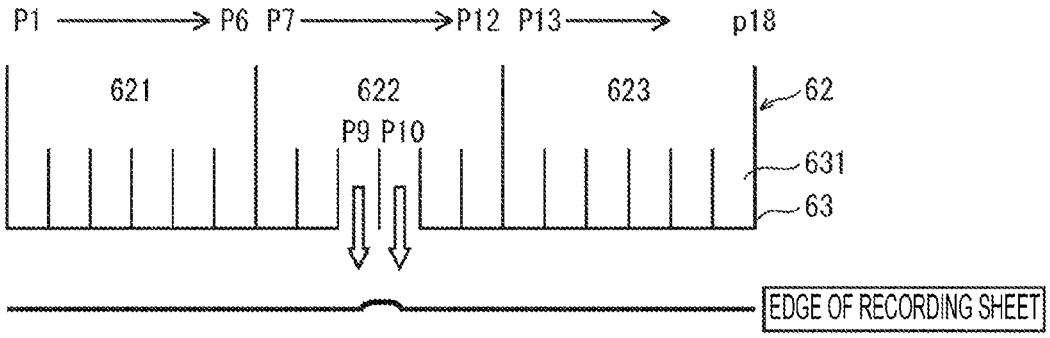
FIGS. 19A to 19C are diagrams schematically illustrating a relationship between change of an edge position of the recording sheet, and small nozzles to be released.
Figure 19B:
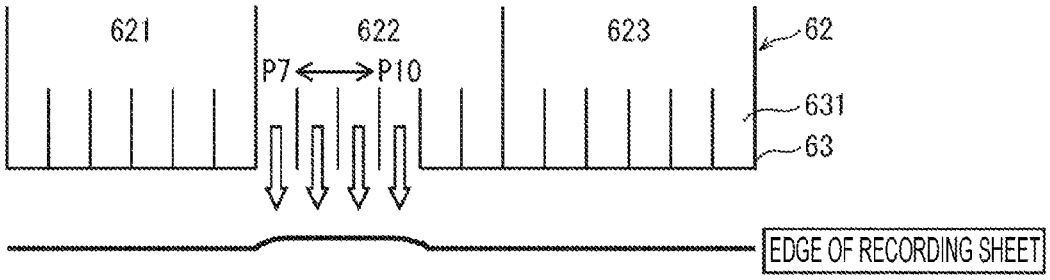
Figure 19C:
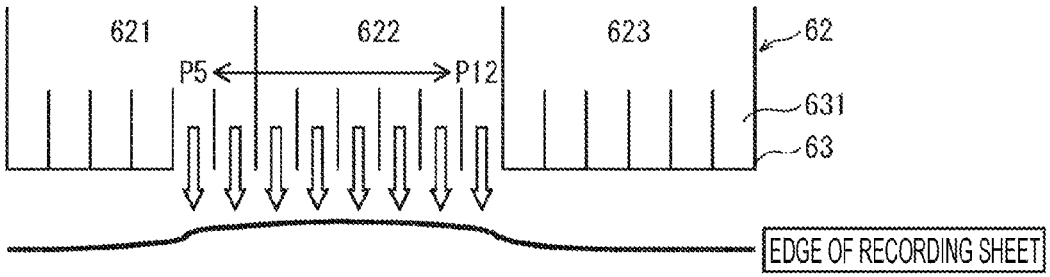

FIGS. 19A to 19C schematically illustrate a corresponding relationship between detection positions of an edge of the recording sheet, and the small nozzles 631 that blow out the air.

In the case of FIG. 19A, the edge position of the recording sheet rises upward in the sections P9 and P10, and the separation states of these sections are determined to be unfavorable. The small nozzles 631 corresponding to the sections P9 and P10 are released.

Further, as illustrated in FIG. 19B, when the separation state of the recording sheet is not favorable in the sections P7 to P10, the small nozzles 631 corresponding to these sections are released.

Further, as illustrated in FIG. 19C, if a range with an unfavorable separation state is enlarged, the small nozzles 631 corresponding to the positions P5 to P12 are controlled to be released.

In the cases of FIGS. 19A and 19B, the range with an unfavorable separation state is the range of the sub-duct 622. Therefore, only the fan device 612 (see FIG. 16) is driven, and it is not necessary to drive the fan devices 611 and 613. In the case of FIG. 19C, the two fan devices 611 and 612 are driven.

As described above, the control section 50 releases the opening portion of the tip of the small nozzle 631 corresponding to the portion with an unfavorable separation state by reference to the determination result table as illustrated in FIG. 18, and can perform air separation only in a necessary place by performing control of driving the fan device corresponding to the sub-duct having the small nozzle 631. Therefore, the separation of the recording sheet can be reliably performed without wastefully taking the heat of the fixing belt 41 and the fixing roller 43.

(6) In the above-described embodiment, the area sensor 45 for imaging the separation state of the tip of the recording sheet that has passed the nip portion N has been used. However, line sensors can be used in place of the area sensor 45. In this case, it is desirable to arrange the line sensors in position different positions in a width direction of a recording sheet, and such that longitudinal directions of the respective line sensors come to a vertical direction (a direction of imaging a nip portion N in a direction perpendicular to an axis of a pressure roller 44).

Of course, a more detailed separation state can be determined as a plurality of line sensors is used and the number of detecting places is increased.

Figure 20:
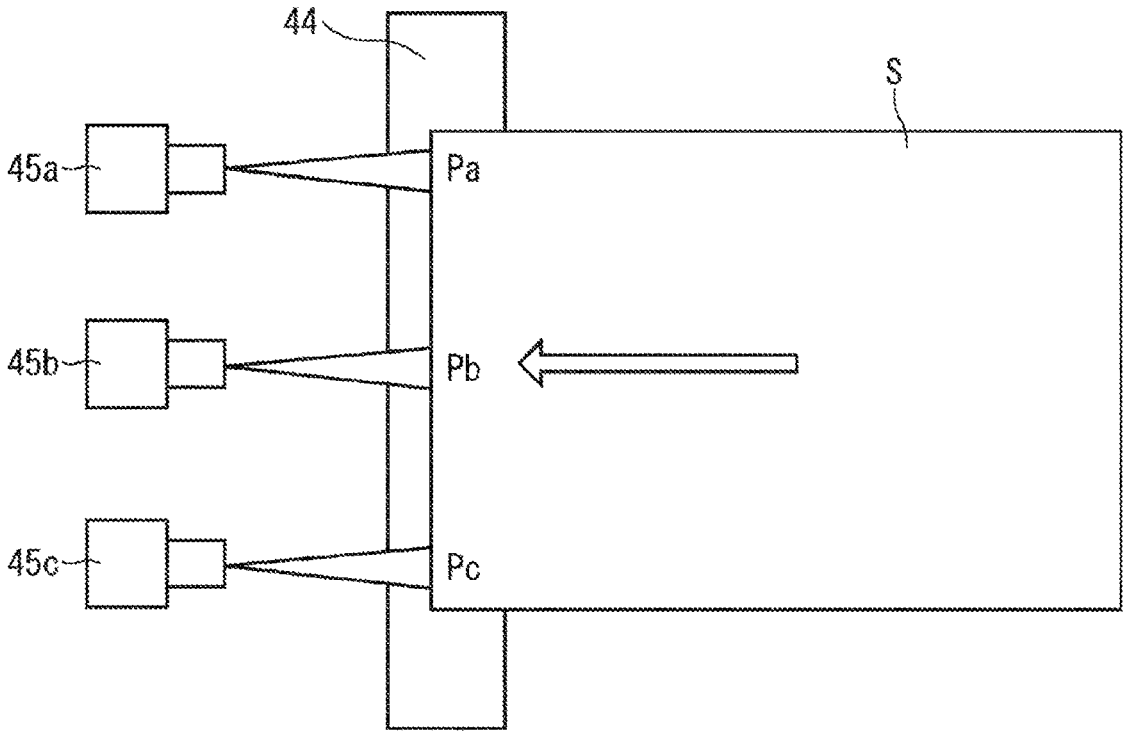
FIG. 20 is a plan view illustrating a configuration example of when a plurality of line sensors is used instead of an area sensor.

In the example illustrated in FIG. 20, three line sensors 45*a* to 45*c* are arranged in positions where both end portions Pa and Pc and a central portion Pb in a sheet width direction can be imaged. An edge is detected from imaging results of the three line sensors, and separation states of the respective positions are determined. If the separation state is not favorable even in one place, an air type separating device 60 is driven, and air separation is performed. According to this configuration, a decrease in cost becomes possible, and high-speed processing can be performed because the number of pixels to be processed is small, compared with the case of using the area sensor 45.

Of course, even in this modification, a configuration of selectively performing air separation of only a target place may be employed, and the air may be blown only to a corresponding portion, like the above-described modification (5).

Further, in a printer that does not use the recording sheet with that large sheet width, the line sensor may be one. This is because deterioration of the separation state can be determined to a certain extent by arranging the one line sensor in a position where the central portion in the sheet width direction is imaged.

Figure 21A:
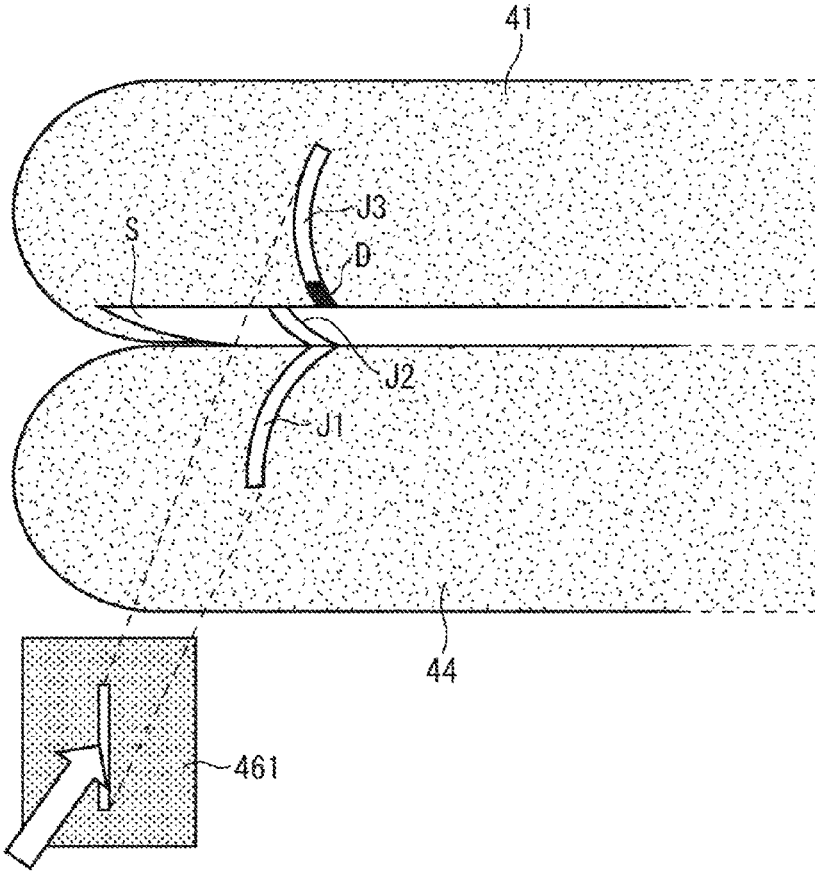
FIGS. 21A and 21B are diagrams illustrating a projection state to surfaces of a fixing belt, a pressure roller, and a recording sheet when a nip portion N is irradiated with a light source through a slit.

(7) In the above-described embodiment, the entire range imaged by the area sensor 45 is illuminated by the illumination unit 46. However, a portion that is an object to be detected of a separation state may be illuminated through a slit 461, as illustrated in FIG. 21A (slit light source).

Figure 21B:
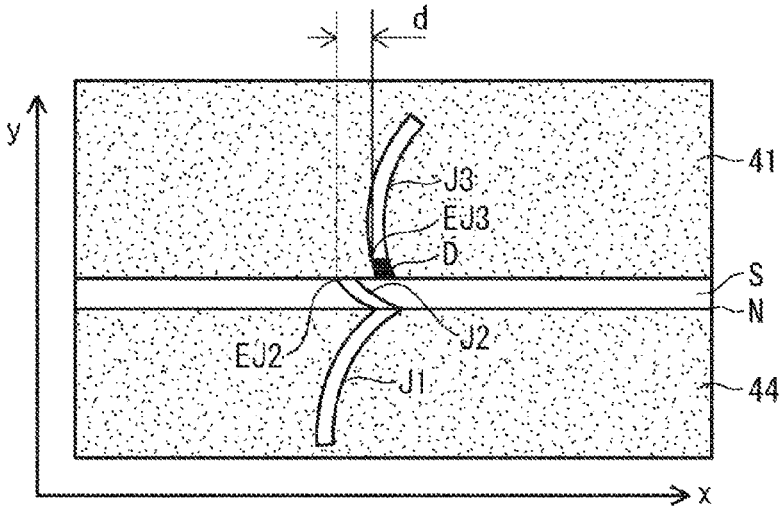

At this time, the shape of the slit light source, which has passed the slit and has projected on the vicinity of a nip portion N is imaged on an area sensor 45 arranged in a nearly center relative to a sheet width direction, by being divided into three portions: a projected portion J1 on a pressure roller 44; a projected portion J2 to a back surface of a tip portion of a recording sheet S; and a projected portion J3 to a fixing belt 41, as illustrated in FIG. 21B.

Especially, the projected portion J2 to the recording sheet S and the projected portion J3 to the fixing belt 41 appear by being divided in the sheet width direction. Therefore, there is an advantage that a difference in brightness between the projected portions and the fixing belt 41 serving as a background becomes distinct, and an edge portion of the projected portion J2 to the recording sheet S can be easily detected.

Such irradiation of the nip portion N with the slit light source is performed in a plurality of positions in the sheet width direction, and separation states in the respective positions may just be determined from imaging results.

Further, according to the present modification, quality of the separation state can be determined according to a positional relationship between the projected portion J2 and the projected portion J3.

That is, when a distance in an x direction between a left end EJ2 of an edge portion of the projected portion J2 with respect to a shadow D of the recording sheet S, and a left end EJ3 of an edge portion of the projected portion J3 with respect to a shadow D of the recording sheet S is d, the value of d becomes smaller as the separation state is worse because the tip of the recording sheet S adheres to a surface of the fixing belt 41, while the value of d becomes large as the separation state is more favorable because the distance between the tip of the recording sheet S and the surface of the fixing belt 41 becomes larger.

Therefore, the edge portion in a boundary of the projected portion J2 on the recording sheet S with respect to the shadow D, and the edge portion in a boundary of the projected portion J3 on the fixing belt 41 with respect to the shadow D are respectively obtained, and the distance d is obtained from the positional information. Then, the distance d is compared with a threshold obtained in advance, so that the separation state can be determined.

However, when the separation state is determined at the plurality of positions in the sheet width direction according to the projected shape of the slit light source, the value of the distance d is changed depending on an imaging direction from the area sensor 45 even if the separation states of the sheet are completely the same (it can be considered that d becomes smaller as a projection position of the slit light source to the nip portion N is closer to the front of the area sensor 45, despite depending on a positional relationship between the light source and the area sensor 45). Therefore, it is desirable to obtain and set an optimum threshold about the distance d in advance for each detection position.

Further, if the determination of the position of the edge of the recording sheet S in the y direction in the above-described embodiment, and the determination of the distance din the present modification are performed together, the separation state of the recording sheet S can be more reliably recognized.

(8) In the above-described embodiment, a guiding member that guides the recording sheet S after passing the nip portion N of the fixing section 40 is not especially disclosed. However, the embodiment needs to have a configuration in which illumination of a detected position of the nip portion N by the illumination unit 46, and imaging of the illuminated detected position are possible. Therefore, it can be considered that a passing portion that is a position close to at least the nip portion N, and for the illumination light and an object image entering the area sensor 45 is formed of transparent glass or a resin plate.

However, if used for a long period, small scratches occur in or toner power adheres to a guiding surface of the guiding plate (especially, the resin plate) due to friction with the recording sheet, and transparency is deteriorated and erroneous detection may occur.

Therefore, in the present modification, the guiding surface is configured from ribs in a range necessary for imaging, and a detection point of a nip portion N can be imaged through a gap between the ribs.

(8-1) Configuration of Arranging Ribs in a Radial Manner

Figure 22A:
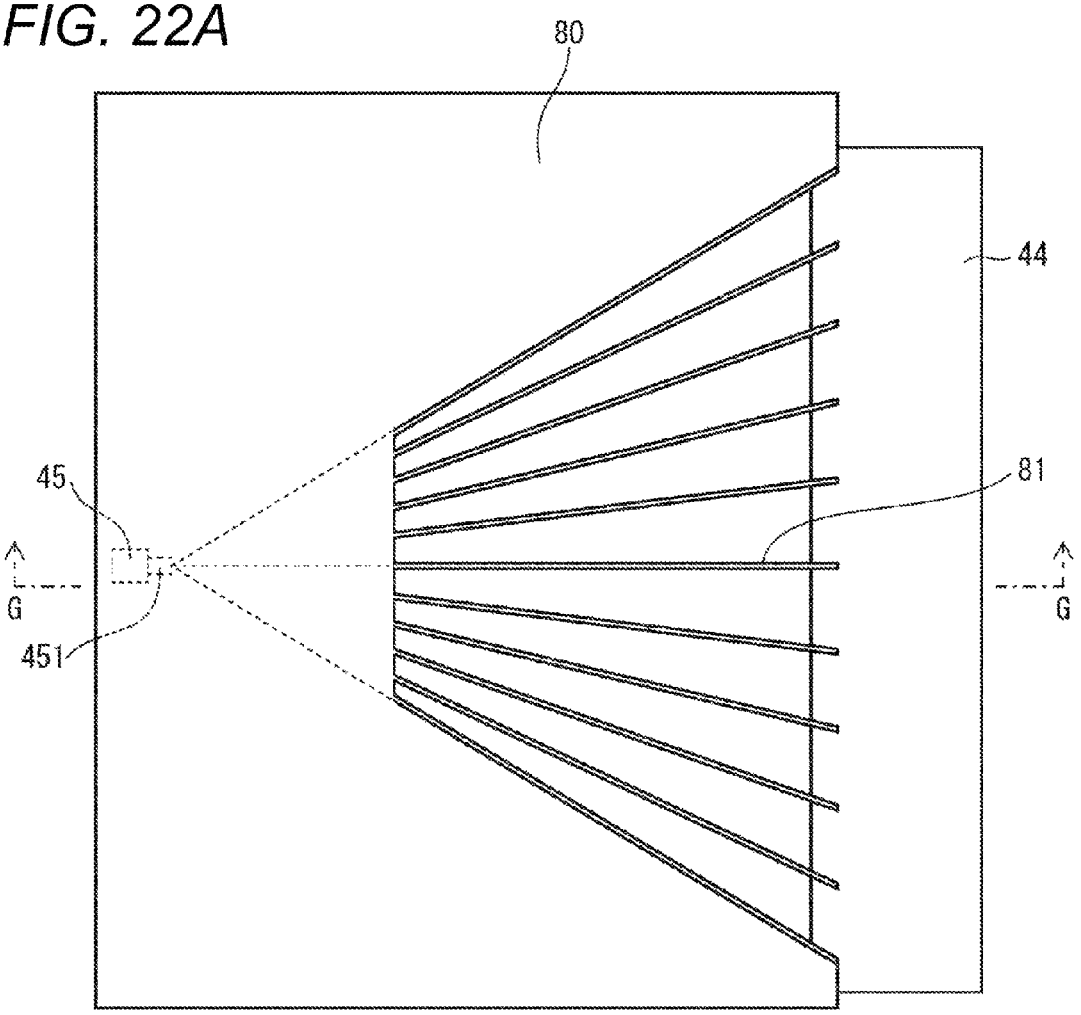
FIG. 22A is a plan view illustrating a configuration example of a guiding plate arranged at a downstream side of the nip portion N of the fixing section.

FIG. 22A is a plan view illustrating a configuration of a guiding plate 80 at a downstream side of the nip portion of a fixing section 40, and here discloses only a pressure roller 44 as an element of the fixing section 40.

As illustrated in FIG. 22A, only a plurality of ribs 81 extending in a radial manner around a lens of an imaging lens 451 of the area sensor 45 is formed in a range necessary for detection of at least a separation state, of the guiding plate 80 formed of a metal, a heat-resistant resin, or the like (hereinafter, a portion guided only by the ribs is referred to as "rib-like guided portion").

The number of ribs 81 is determined according to strength necessary as a guide, and the number of detection points in a direction along the nip portion N.

Figure 22B:
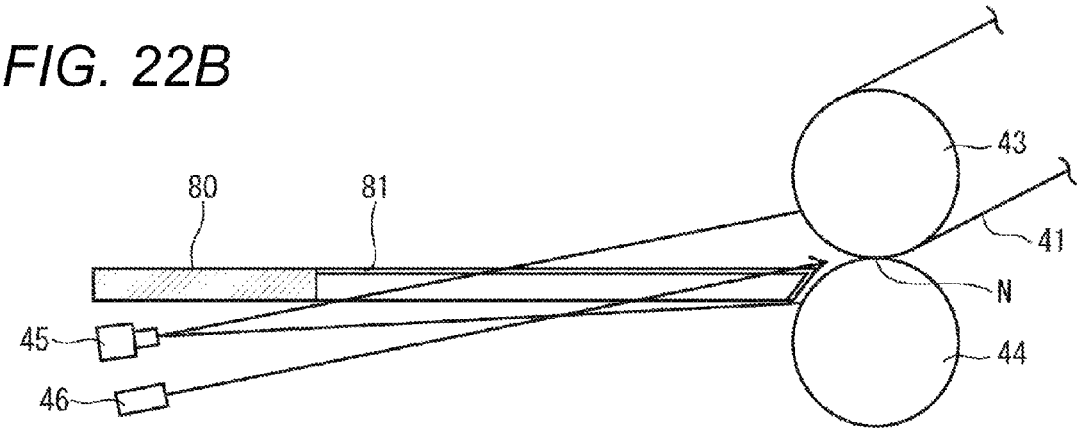
FIG. 22B is a G-G line arrow cross-sectional view of the configuration example.

FIG. 22B schematically illustrates an arrow cross-sectional view in the G-G line of FIG. 22A.

As illustrated in FIG. 22B, an image with a width V1 in a vertical direction can be taken through a gap of the ribs 81, to an area sensor 45 through an imaging lens 451.

If an illumination unit 46 is configured to diffuse a single light source in a radial manner, and is arranged in a position below the area sensor 45, and the position nearly the same as the area sensor 45 from the nip portion N, the illumination unit 46 can reliably irradiate the detection position along the nip portion N.

(8-2) Configuration of Arranging Ribs in Parallel

Figure 23A:
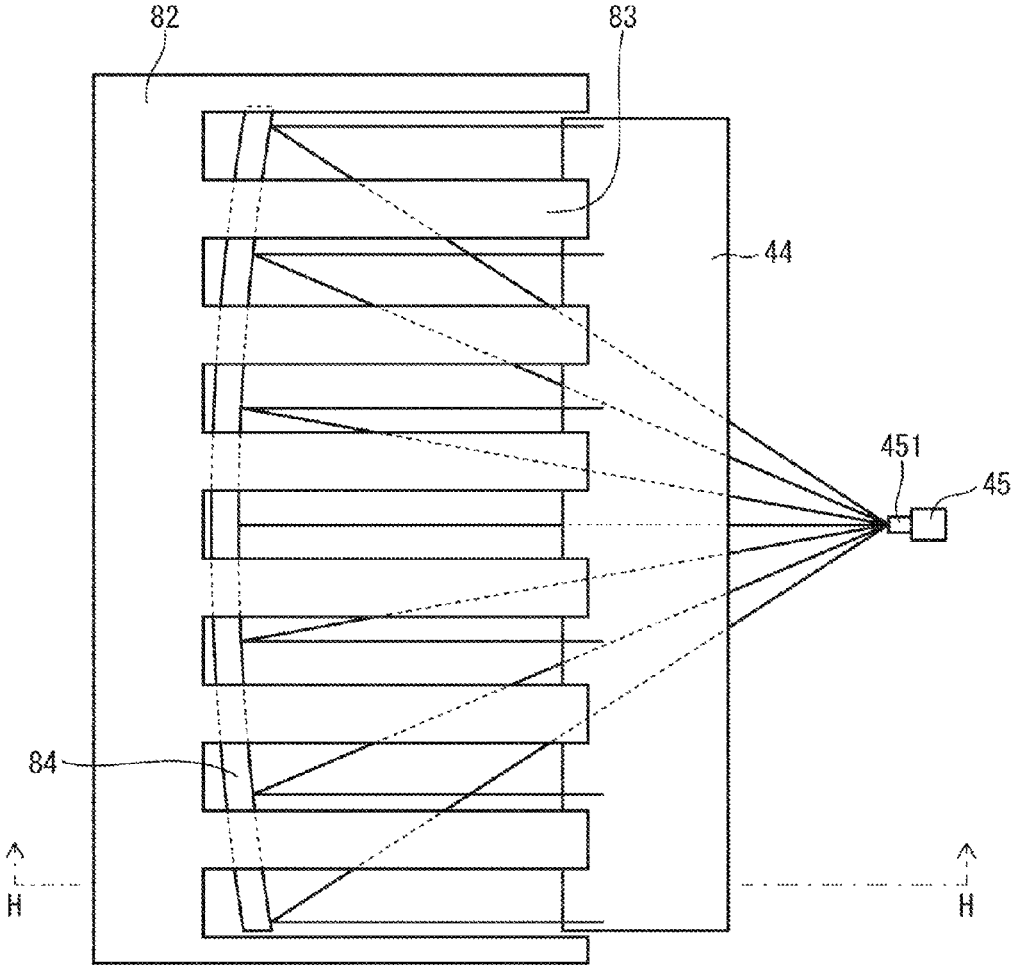
FIG. 23A is a plan view illustrating another configuration example of a guiding plate arranged at a downstream side of a nip portion N of a fixing section.

FIG. 23A is a schematic plan view illustrating a configuration example of a guiding plate 82 in which a rib-like guided portion is configured from a plurality of ribs 83 arranged in parallel in a sheet passing direction of a recording sheet.

This example is configured such that a long and narrow concave mirror 84 (focusing optical system) is arranged at a downstream side of a nip portion N, and light passing through a plurality of ribs 83 from a position to be determined of a separation state of the nip portion N and incident in parallel is reflected at the concave mirror 84 and focused to an area sensor 45.

The number and the positions of the ribs 83 are designed not to block an image at a determination position of the separation state of a sheet to be imaged in the area sensor 45.

Figure 23B:
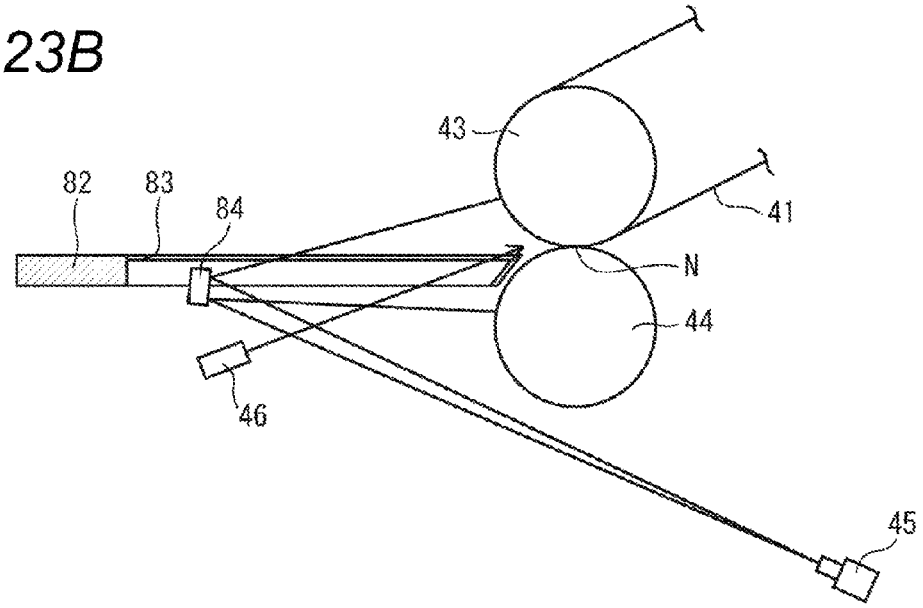
FIG. 23B is an H-H line arrow cross-sectional view of the configuration example.

FIG. 23B is an H-H line arrow cross-sectional view in FIG. 23A. As illustrated in FIG. 23B, a reflection surface of the concave mirror 84 is slightly tilted in a right direction, so that the area sensor 45 can be arranged in a space below a fixing section 40.

An illumination unit 46 may also be arranged near the area sensor 45 and a concave mirror similar to the concave mirror 84 may be provided, and the illumination unit 46 may irradiate the nip portion N. However, in the present example, the illumination unit 46 is installed below the concave mirror 84. The illumination unit 46 of this case with diffused light by a single light source cannot irradiate a detection point because light traveling to both ends in an axial direction, of a pressure roller 44, is blocked by the ribs 81. Therefore, a straight tube fluorescent lamp having a length of the sheet width or more, or a plurality of LEDs is arranged in positions corresponding to gaps between the ribs 81.

Although not especially illustrated in FIGS. 22 and 23, a normal guiding plate without ribs is arranged above and facing the guiding plates 80 and 82, and a recording sheet conveying path is formed of a pair of upper and lower guiding plates.

When the area sensor 45 or the illumination unit 46 is arranged above a sheet conveying path St as illustrated in FIG. 7, it goes without saying that it is necessary to form the upper and lower guiding plates into a shape similar to the guiding plates 80 and 82.

Figure 24A:
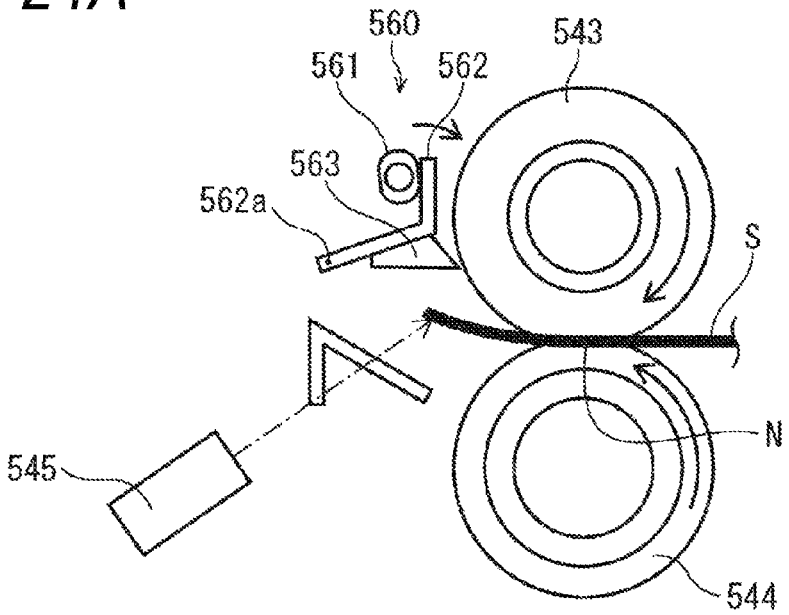
FIG. 24A is a diagram illustrating a configuration in which a separation state of a recording sheet is detected using a laser displacement sensor in a conventional fixing device.
Figure 24B:
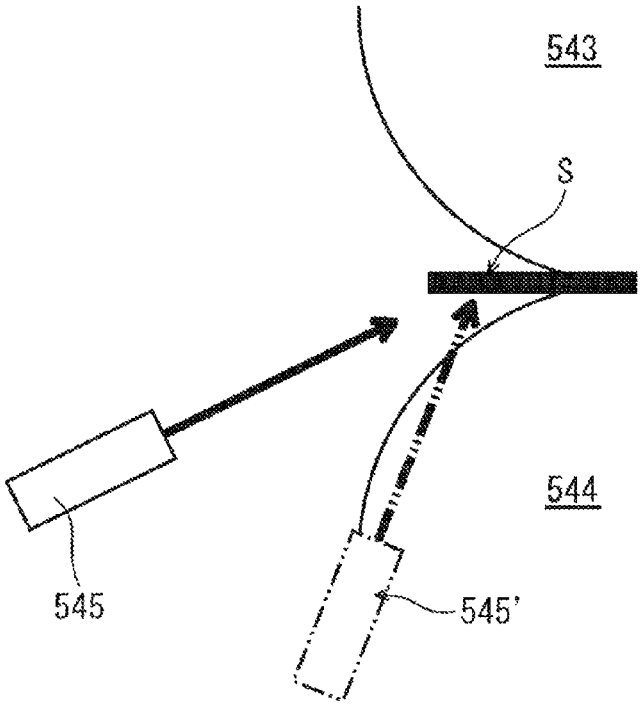
FIG. 24B is a reference diagram for describing problems in the conventional configuration.

(9) In the above-described embodiment, the air is blown to the tip of the recording sheet by the air type separating device 60, and the force acting on the recording sheet to be separated from the fixing belt 41 (fixing rotating body) has been provided. However, a method of promoting a favorable separation state is not limited to the air type separating device 60. As introduced in FIG. 24A, a separating claw is configured to be able to approach/be separated from a peripheral surface of a fixing rotating body, and the separating claw may be brought to come in contact with the fixing rotating body when the separation state is not favorable. However, a unit to move the separating claw is not limited to a cam mechanism, and any mechanism can be employed as long as the mechanism is a known displacement mechanism.

Note that it is also possible to arrange a plurality of separating claws in a main scanning direction, and is independently arranged to be able to approach/be separated from the peripheral surface of the fixing rotating body, and to operate the separating claw in a corresponding position when a separation state is detected to be partially unfavorable, as illustrated in FIG. 16. The surface of the fixing rotating body is not wastefully damaged by bringing the separating claw to come in contact with a place that does not require enhancement/assistance of separation.

Other than the above, as a unit to forcibly separate a recording sheet from a surface of a fixing rotating body, it is not impossible to have a configuration of sucking a tip portion of the recording sheet from an opposite direction to the fixing rotating body, and charging the recording sheet to electrostatically attract the recording sheet in a direction of removing the recording sheet from the fixing rotating body.

(10) In the above-described embodiment, only the case in which the recording sheet adheres to the side of the fixing belt 41 that is the fixing rotating body has been described. However, in an image forming apparatus that can perform double-sided printing, a toner of a toner image formed on a first surface is re-heated, and adhesive force is slightly caused, at thermal fixation of a toner image formed on a second surface. When an amount of adhesion of the toner on the first surface is relatively larger than that on the second surface, the recording sheet may adhere to a side of a pressure rotating body. In this case, the position of an edge of the recording sheet is displaced lower than a predetermined position. Therefore, quality of a separation state can be determined, similarly to the embodiment. Further, a sheet separating mechanism similar to the embodiment is provided along a peripheral surface of the pressure rotating body at a downstream side of a nip portion N, and the sheet separating mechanism may just be operated according to determination of the quality of the separating state between the pressure rotating body and the recording sheet.

(11) In the above-described embodiment, the illumination unit 46 is irradiated for a predetermined time, and the image data of the area sensor 45 of that time has been acquired (step S14 of FIG. 6) at imaging timing (YES at step S13 of FIG. 6). This embodiment is premised on the configuration in which light from outside is not incident, and the area sensor 45 is covered so that light does not reach the area sensor 45 even if there is another light source in the device.

Other than the above, a configuration of providing a shutter device to an imaging lens 451, and releasing the shutter for a predetermined time and performing exposure at imaging timing, in a state where an illumination unit 46 is lighted, may be employed. Further, a configuration of taking only image data of frames corresponding to the imaging timing, of images sequentially captured by an area sensor 45, and using the image data for determination of a sheet separation state, may be employed.

(12) In the above-described embodiment, an example of the fixing device using the fixing belt has been described. However, a configuration of directly forming a nip portion N by a fixing roller and a pressure roller without through a fixing belt may be employed. Further, the light source is not limited to the halogen heater, and a system of heating a heat generation layer of the fixing belt by electromagnetic induction using an exciting coil, or a system of heating the fixing belt by a resistance heating element may be employed.

In essence, any fixing device is applicable as long as the fixing device forms a nip portion by a heated fixing rotating body and a pressure rotating body that presses the fixing rotating body, and passes a recording sheet to the nip portion and fixes the sheet.

(13) In the above-described embodiment, the fixing section in the image forming apparatus has been described. However, the separation jam may occur not only in the fixing section, but also in another conveying system such as the transfer section.

For example, in FIG. 1, when a toner image formed on an intermediate transfer belt 26 as an image carrying rotating body is secondarily transferred on a recording sheet by a secondary transfer roller (transfer rotating body) 27, the recording sheet adheres to a surface of the intermediate transfer belt 26 or the secondary transfer roller 27 due to electrostatic attraction or the like, and the recording sheet may not be able to be separated only by curvature separation.

In a monochrome-dedicated image forming apparatus that does not use the intermediate transfer belt, as illustrated in FIG. 1, a transfer section has a configuration of passing the recording sheet to a nip between the transfer section and a transfer roller, and transferring a toner image formed on a peripheral surface of a photoreceptor drum (photoreceptor rotating body) as an image carrying rotating body to the recording sheet. Therefore, even in this case, the recording sheet adheres to the peripheral surface of the photoreceptor drum or the transfer roller, and a separation jam may occur.

Therefore, even in a place including such a transfer function, it is desirable to detect an edge of the recording sheet from an image that is an imaged nip portion imaged by an area sensor, and operate a sheet separating mechanism to separate the recording sheet from the surface of the rotating body if a separation state is not favorable, similarly to the fixing section.

However, in this case, it is desirable not to employ an air separation system as the sheet separating mechanism. This is because an unfixed toner on the recording sheet may be blown off.

Note that, in a model having a configuration of irradiating a photosurface of a photoreceptor drum with an eraser lamp, before uniformly charging a recording sheet with a charging device after transferring a toner image on the photoreceptor drum to the recording sheet, and removing residual electric charges of the photoreceptor drum, the eraser lamp may also be used as an illumination unit used when a nip portion is imaged. Accordingly, parts count can be decreased, and contribution to a decrease in manufacturing cost can be made.

(14) In the above-described embodiment, the tandem type color copying machine has been described. However, an embodiment is not limited thereto, any image forming apparatus such as a fax, a copying machine, a multiple function peripheral (MFP) or the like may be employed as long as the image forming apparatus includes a fixing section and a transfer section (see the modification (13)). Further, a monochrome image forming apparatus may be employed.

Further, the present invention can be applied as a typical sheet conveying device, other than the image forming apparatuses, the sheet conveying device having a configuration of passing a sheet to a nip portion of a pair of rotating bodies and conveying the sheet, and having a possibility in which some sort of adhesive force acts between the sheet and a peripheral surface of the rotating body, and a trouble such as a separation jam occurs.

Further, the embodiments and the modifications may be combined to the extent possible.

The present invention is suitable as a technology to determine a separation state between a tip of a sheet that has passed a nip portion of a fixing device and a rotating body.

According to an embodiment of the present invention, an imaging unit that images a tip portion of a sheet that has passed a nip portion is included, and a separation state between the sheet that has passed the nip portion and the surface of the first rotating body is determined by detecting of a tip (edge) of the tip portion of the sheet based on imaged image data. Accordingly, only if the imaging unit is arranged at a position where the nip portion can be imaged, the tip of the passed sheet can be easily imaged. Therefore, the separation state of the tip of the sheet immediately after passing the nip portion can be more precisely determined than a case where determination is performed using a laser displacement sensor having lower degree of freedom in installation like a conventional case.

Further, the sheet separating unit is operated based on a precise determination result, whereby occurrence of a separation jam can be more reliably prevented while removing harmful influence of operating the sheet separating unit on a steady basis.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet conveying device that passes a sheet to a nip portion formed between first and second rotating bodies and conveys the sheet, the sheet conveying device comprising:

a separation state determining unit configured to determine a separation state between the sheet having passed the nip portion and a surface of the first rotating body;

a sheet separating unit configured to allow force to act on the sheet, the force being in a direction of being separated from the surface of the first rotating body; and a control unit configured to control the force acting on the sheet by the sheet separating unit according to a result of the separation state determining unit, wherein the separation state determining unit includes an illumination unit configured to illuminate an outlet side of the nip portion in a sheet passing direction, an imaging unit configured to image a tip portion of the sheet having passed the nip portion, and an acquisition unit configured to acquire positional information of a tip of the sheet based on image data obtained by the imaging unit, and the separation state between the sheet and the first rotating body is determined based on the acquired positional information of a tip of the sheet.

2. The sheet conveying device according to claim 1, comprising:

a detecting unit configured to detect passing of the tip of the sheet at an upper stream side than the nip portion in a sheet conveying direction, wherein the imaging unit images the tip portion of the sheet using timing when the tip of the sheet is detected by the detecting unit is a reference time, and setting timing after a lapse of a predetermined time from the reference time as imaging timing.

3. The sheet conveying device according to claim 1, comprising:

a detecting unit configured to detect passing of the tip of the sheet at an upper stream side than the nip portion in a sheet conveying direction, wherein the imaging unit sequentially images the tip portion of the sheet having passed the nip portion, and the acquisition unit acquires the positional information of a tip of the sheet, based on image data imaged at timing after a lapse of a predetermined time from a reference time, using timing when the tip of the sheet is detected by the detecting unit as the reference time, of image data obtained through the sequential imaging.

4. The sheet conveying device according to claim 1, wherein the imaging unit is arranged in a position at a downstream side of the nip portion in a sheet conveying direction, and is a position where the imaging unit images a back surface side of the tip portion of the sheet when the tip portion of the sheet having passed the nip portion approaches a peripheral surface of the first rotating body, and the illumination unit is arranged in a position where a shadow of the tip portion of the sheet is generated on the peripheral surface of the first rotating body, and the appearing shadow is imaged by the imaging unit.

5. The sheet conveying device according to claim 1, wherein the imaging unit is arranged in a position at a downstream side of the nip portion in a sheet conveying direction, and is a position where the imaging unit is able to image an end surface of the tip of the sheet when the tip portion of the sheet having passed the nip portion approaches a peripheral surface of the first rotating body, and the illumination unit is arranged in a position where the illumination unit illuminates the end surface of the tip of the sheet.

6. The sheet conveying device according to claim 1, wherein the imaging unit includes one or a plurality of line sensors arranged such that an imaging range becomes a range extending in a direction perpendicular to a direction into which the nip portion is extended.

7. The sheet conveying device according to claim 1, wherein the imaging unit is an area sensor.

8. The sheet conveying device according to claim 7, wherein the illumination unit is a slit light source that performs irradiation through a slit, and the separation state determining unit determines the separation state, based on a captured image of projection light to a peripheral surface of the first rotating body and the tip portion of the sheet, of the slit light source.

9. The sheet conveying device according to claim 7, comprising:

a sheet width acquisition unit configured to acquire information related to a sheet width in a direction perpendicular to the sheet passing direction of a passed sheet, wherein the imaging unit switches an imaging range in the direction perpendicular to the sheet passing direction according to a size of the sheet width, and images the tip portion of the sheet.

10. The sheet conveying device according to claim 7, comprising:

a deteriorating tendency determining unit configured to determine, when a plurality of sheets is sequentially passed, whether the separation state is in deteriorating tendency according to a history of the determination of the separating state in the passing of a most recent one sheet or a most recent plurality of sheets, wherein the imaging unit sets only a part of a range in the sheet width direction as an imaging range until the separation state is determined to be in the deteriorating tendency by the deteriorating tendency determination unit, and switches the part of a range to a range wider than the part of a range in the sheet width direction after the separation state is determined to be in the deteriorating tendency, and images the tip portion of the sheet.

11. The sheet conveying device according to claim 7, wherein, when a plurality of sheets is sequentially passed, the imaging unit sets an imaging range in the direction perpendicular to a direction into which the nip portion is extended, as a first range, at an initial stage, and when a position of the tip of the sheet obtained in the acquisition unit is predicted to fall within a predetermined range, the imaging unit switches the imaging range to a second range narrower than the first range in the direction perpendicular to a direction into which the nip portion is extended, and images the tip portion of the sheet.

12. The sheet conveying device according to claim 9, wherein the imaging unit is a two-dimensional CCD, and when a range smaller than an entire imagable range by the two-dimensional CCD is an imaging range for determination of the separation state of the sheet, a period of a transfer pulse of an electric charge of a pixel in a range other than the imaging range for determination, of the entire imagable range, is made faster than a period of a transfer pulse of an electric charge of a pixel in the imaging range for determination.

13. The sheet conveying device according to claim 7, wherein the separation state determining unit acquires information indicating distribution of the separation state of the sheet along a direction into which the nip portion is extended, and the sheet separating unit is able to independently change the force acting on the sheet in the direction of being separated from the surface of the first rotating body, in a plurality of places in a sheet width direction, and the control unit controls the force acting on the sheet in each of the places by the sheet separating unit based on the information indicating distribution of the separation state.

14. The sheet conveying device according to claim 7, comprising:

a sheet conveying guide configured to guide the sheet after passing the nip portion, wherein the sheet conveying guide includes a rib-like guided portion in which a plurality of ribs is arranged in a radial manner not to disturb a capturing optical path by the area sensor, of a portion that is an object to be determined of the separation state of the sheet in the nip portion.

15. The sheet conveying device according to claim 7, comprising:

a sheet conveying guide configured to guide the sheet after passing the nip portion; and an optical system configured to convert a capturing optical path into a parallel capturing optical path in a middle of the capturing optical path from the area sensor to the nip portion, wherein the sheet conveying guide includes a rib-like guided portion in which a plurality of ribs is arranged in a radial manner not to disturb the parallel capturing optical path in which the portion that is an object to be determined of the separation state of the sheet in the nip portion is captured.

16. An image forming apparatus comprising:

the sheet conveying device according to claim 1, as a conveying system of a recording sheet.

17. The image forming apparatus according to claim 16, wherein the conveying system includes a fixing device, and a fixing rotating body and a pressure rotating body in the fixing device respectively correspond to first and second rotating bodies in the sheet conveying device.

18. The image forming apparatus according to claim 16, wherein the conveying system includes a transfer device, and an image carrying rotating body that carries a toner image and a transfer rotating body that transfers the toner image on the recording sheet in the transfer device respectively correspond to first and second rotating bodies in the sheet conveying device.

19. The image forming apparatus according to claim 18, wherein the image carrying rotating body is a photoreceptor rotating body, and includes an eraser lamp that removes an electric charge of the photoreceptor rotating body after transfer of the toner image to the recording sheet, and the eraser lamp also serves as the illumination unit for imaging in the sheet conveying device.

* * * * *